US010433613B2

(12) United States Patent
Litvinov

(10) Patent No.: US 10,433,613 B2
(45) Date of Patent: Oct. 8, 2019

(54) VENTILATION APPARATUS FOR FOOTWEAR

(71) Applicant: Alexander Litvinov, Brooklyn, NY (US)

(72) Inventor: Alexander Litvinov, Brooklyn, NY (US)

( * ) Notice: Subject to any disclaimer, the term of this patent is extended or adjusted under 35 U.S.C. 154(b) by 30 days.

(21) Appl. No.: 15/700,413

(22) Filed: Sep. 11, 2017

(65) Prior Publication Data

US 2018/0020768 A1 Jan. 25, 2018

Related U.S. Application Data

(63) Continuation-in-part of application No. 14/596,128, filed on Jan. 13, 2015, now Pat. No. 10,010,132.

(60) Provisional application No. 61/964,756, filed on Jan. 13, 2014.

(51) Int. Cl.

| | |
|---|---|
| ***A43B 7/08*** | (2006.01) |
| ***A43B 7/00*** | (2006.01) |
| ***A43B 3/00*** | (2006.01) |

(52) U.S. Cl.

CPC ..... *A43B 7/084* (2013.01); *A43B 3/0005* (2013.01); *A43B 3/0015* (2013.01); *A43B 7/005* (2013.01); *A43B 7/081* (2013.01); *A43B 7/082* (2013.01); *A43B 7/085* (2013.01)

(58) Field of Classification Search

CPC ..... A43B 7/084; A43B 7/081; A43B 7/082; A43B 7/005; A43B 3/0015; A43B 3/0005; A43B 7/06; A43B 13/203

USPC ..... 36/3 R, 3 A, 3 B, 29

See application file for complete search history.

(56) References Cited

U.S. PATENT DOCUMENTS

| | | | | | |
|---|---|---|---|---|---|
| 2,676,422 | A * | 4/1954 | Crawford | A43B 7/06 | 36/3 R |
| 2,716,293 | A * | 8/1955 | Rath | A43B 7/06 | 36/3 A |
| 3,027,659 | A * | 4/1962 | Gianola | A43B 7/06 | 36/3 R |
| 3,048,931 | A * | 8/1962 | Farinello | A43B 7/06 | 36/3 R |
| 3,273,264 | A * | 9/1966 | Farinello, Jr. | A43B 3/0005 | 36/3 A |
| 3,284,930 | A * | 11/1966 | Baldwin | A43B 7/081 | 36/147 |

(Continued)

*Primary Examiner* — Jameson D Collier
*Assistant Examiner* — Jocelyn Bravo
(74) *Attorney, Agent, or Firm* — Ashok Tankha

(57) ABSTRACT

A ventilation apparatus including at least one flexible energy storage device (FESD), a switching unit, a pump, and a fluid diffuser is provided. The FESD flexibly conforms to varying contours of footwear. The FESD positioned at one or more locations of the footwear supplies electrical energy to the pump via the switching unit. The switching unit in communication with the FESD and the pump selectively changes modes of operation of the pump. The pump attached to the footwear pumps fluid into and exhausts fluid from a cavity of the footwear. A feed pipe of the fluid diffuser connected to the pump, within the cavity of the footwear, transfers the fluid pumped from the pump to the cavity of the footwear during a pump mode and transfers the fluid in the cavity of the footwear to an ambient environment external to the footwear during an exhaust mode for ventilating the footwear.

7 Claims, 23 Drawing Sheets

(56) References Cited

U.S. PATENT DOCUMENTS 3,906,185 A * 9/1975 Gross ..... A43B 3/0005 219/211
4,102,061 A * 7/1978 Saaristo ..... A43B 7/081 36/28
4,417,407 A * 11/1983 Fukuoka ..... A43B 7/082 36/29
4,420,893 A * 12/1983 Stephan ..... A43B 7/06 36/118.2
4,703,754 A * 11/1987 Ibbott ..... A43B 17/04 36/44
4,948,951 A * 8/1990 Balzano ..... A41D 19/01535 219/211
5,179,792 A * 1/1993 Brantingham ..... A43B 3/0005 251/4
5,222,312 A * 6/1993 Doyle ..... A43B 13/203 36/28
5,333,397 A * 8/1994 Hausch ..... A43B 17/08 36/3 B
5,375,345 A * 12/1994 Djuric ..... A43B 3/00 36/3 B
5,592,759 A * 1/1997 Cox ..... A43B 1/0054 36/136
5,649,376 A * 7/1997 Lecates, Jr. ..... A43B 3/0005 36/137
5,675,914 A * 10/1997 Cintron ..... A43B 17/08 36/29
5,813,140 A * 9/1998 Obeid ..... A43B 7/081 36/3 A
5,819,438 A * 10/1998 Wanniarachchi ..... A43B 7/06 36/3 R
5,845,417 A * 12/1998 Reed ..... A43B 7/081 36/3 B
5,865,523 A * 2/1999 Chien ..... A43B 1/0036 36/137
5,953,834 A * 9/1999 Clodic ..... A41D 13/005 36/2.6
5,953,835 A * 9/1999 Kwon ..... A43B 7/32 36/153
6,041,518 A * 3/2000 Polycarpe ..... A43B 3/0005 36/2.6
6,041,519 A * 3/2000 Cheng ..... A43B 7/081 36/29
6,255,799 B1 * 7/2001 Le ..... A43B 3/00 219/211
6,370,800 B1 * 4/2002 Hung ..... A43B 7/08 36/29
6,477,789 B2 * 11/2002 Cheng ..... A43B 7/081 36/28
7,264,599 B1 * 9/2007 Milligan ..... A43B 3/0005 36/141
7,269,915 B2 * 9/2007 Flechsig ..... A43B 7/081 36/114
7,716,853 B2 * 5/2010 Finnegan ..... A43B 5/08 36/3 B
8,209,882 B2 * 7/2012 Leimer ..... A43B 3/0005 36/29
8,291,612 B2 * 10/2012 Ferguson ..... A43B 1/0045 219/211
9,107,468 B1 * 8/2015 Xiong ..... A43B 7/02
2002/0066207 A1 * 6/2002 Cheng ..... A43B 7/081 36/3 R
2002/0069552 A1 * 6/2002 Ortiz ..... A43B 3/0005 36/3 R
2002/0189135 A1 * 12/2002 Hanks ..... A43B 1/0018 36/54
2003/0121174 A1 * 7/2003 Tsai ..... A43B 7/081 36/3 B
2003/0145486 A1 * 8/2003 Cardarelli ..... A43B 3/0078 36/3 B
2003/0145488 A1 * 8/2003 Cardarelli ..... A43B 3/0078 36/3 R
2003/0188451 A1 * 10/2003 Wu ..... A43B 7/081 36/3 B
2004/0020076 A1 * 2/2004 Liu ..... A43B 1/0045 36/3 R
2004/0088882 A1 * 5/2004 Buttigieg ..... A43B 13/203 36/3 B
2004/0159022 A1 * 8/2004 Winford ..... A43B 1/0027 36/136
2004/0163278 A1 * 8/2004 Caspers ..... A43B 5/0405 36/3 R
2005/0060906 A1 * 3/2005 Zimerfeld ..... A43B 3/0005 36/3 R
2005/0183286 A1 * 8/2005 Crary ..... A43B 7/081 36/3 B
2005/0241179 A1 * 11/2005 Chen ..... A43B 7/08 36/3 A
2005/0261609 A1 * 11/2005 Collings ..... A43B 3/0005 600/592
2006/0032083 A1 * 2/2006 Lim ..... A43B 7/082 36/3 B
2006/0101674 A1 * 5/2006 Ungari ..... A43B 1/0027 36/137
2007/0260421 A1 * 11/2007 Berner, Jr. ..... A43B 3/0005 702/160
2008/0066343 A1 * 3/2008 Sanabria-Hernandez ..... A43B 3/0005 36/43
2008/0263899 A1 * 10/2008 Lee ..... A43B 1/0045 36/102
2009/0044431 A1 * 2/2009 Hypponen ..... A43B 7/08 36/3 B
2009/0084001 A1 * 4/2009 Sgattoni ..... A43B 7/081 36/3 A
2010/0005687 A1 * 1/2010 Ramadoro (An) .. A43B 3/0005 36/3 B
2011/0306299 A1 * 12/2011 Wells ..... A43B 3/0021 455/41.3
2012/0198729 A1 * 8/2012 Graziani ..... A43B 7/082 36/3 R
2013/0019503 A1 * 1/2013 Vogt ..... A43B 3/0005 36/103
2013/0247410 A1 * 9/2013 Tseng ..... A43B 7/02 36/2.6
2013/0247424 A1 * 9/2013 Tseng ..... A43B 3/0005 36/136
2014/0013632 A1 * 1/2014 Mohlmann ..... A43B 7/081 36/25 R
2014/0259790 A1 * 9/2014 Faggin ..... A43B 7/005 36/103
2015/0027005 A1 * 1/2015 Lee ..... A43B 7/081 36/102
2015/0048942 A1 * 2/2015 Bertagna ..... A43B 13/38 340/539.13
2015/0196084 A1 * 7/2015 Litvinov ..... A43B 3/0015 36/3 R
2016/0029740 A1 * 2/2016 Mohlmann ..... A43B 7/081 36/3 B
2019/0013755 A1 * 1/2019 Stach ..... H02P 9/04

* cited by examiner

VENTILATION APPARATUS FOR FOOTWEAR

CROSS-REFERENCE TO RELATED APPLICATIONS

This application is a continuation-in-part application of non-provisional patent application titled "Ventilation Of Footwear", application Ser. No. 14/596,128, filed in the United States Patent and Trademark Office on Jan. 13, 2015, which claims priority to and the benefit of provisional patent application titled "Method of mechanical ventilation of shoes", application No. 61/964,756, filed in the United States Patent and Trademark Office on Jan. 13, 2014. The specifications of the above referenced patent applications are incorporated herein by reference in their entirety.

BACKGROUND

When a person wears a proper fitting shoe, there is typically a minimal gap between an inner surface of the shoe and the surface of the person's foot inserted in the shoe. If there is no ventilation inside the shoe and the ambient temperature is high, for example, during hot summer weather or in an office environment, or when the person performs physical activities, for example, working, walking, running, exercising, etc., the air around the person's foot in the shoe becomes warm and quickly fills with water vapor which creates an uncomfortable environment around the person's foot inside the shoe. Closed shoes, for example, closed sneakers, high boots, etc., have minimal air exchange or ventilation at the front end of the shoes. Therefore, there is a need for removal of air from the shoe, especially from the front end and other parts of the shoe to improve comfort, hygiene, and foot adhesion inside the shoe.

Conventional methods for ventilating shoes typically provide ventilation holes on an outer surface of the shoe, or an arrangement of pistons to eject air out of the shoe. However, these methods actively function only when a person walks while wearing the shoe. Moreover, adding ventilation holes on the outer surface of the shoe changes the shoe design, which may not be aesthetically appealing, Furthermore, ventilating shoes by using pistons requires incorporation of bulky and ineffective additional parts into the shoe design.

Some conventional methods employ battery powered electric ventilation systems to ventilate the shoe. However, in such systems, conventional batteries are firmly fixed in the shoe, cannot be positioned at any location inside or outside the shoe, and are not easily replaceable. Moreover, conventional batteries in these battery powered electric ventilation systems are bulky and occupy more space in the shoe which may be obstructive to a user wearing the shoe and makes it difficult for the user to walk around while wearing the shoe. Furthermore, conventional batteries in these battery powered electric ventilation systems are rigid and do not conform to varying contours of the shoe, which may damage the batteries or injure the user wearing the shoe during use of the shoe.

Hence, there is a long felt need for a method and an apparatus for ventilating footwear, for example, shoes, at different times, for example, during rest, during movement, during any physical activity, during high temperature situations, while the user is in a warm environment, or at selected times. Furthermore, there is a need for flexible batteries that are compact, occupy less space in the footwear, flexibly conform to varying contours of the footwear, can be easily accommodated at any location inside or outside the footwear, and can be easily replaced, without obstructing or injuring a user wearing the footwear and without causing damage to the batteries.

SUMMARY OF THE INVENTION

This summary is provided to introduce a selection of concepts in a simplified form that are further disclosed in the detailed description of the invention. This summary is not intended to determine the scope of the claimed subject matter.

The method and the ventilation apparatus disclosed herein address the above recited need for ventilating footwear, for example, a user's shoes, at different times, for example, during rest, during movement, during any physical activity, during high temperature situations, while the user is in a warm environment, or at selected times. Furthermore, the ventilation apparatus disclosed herein addresses the above recited need for flexible energy storage devices, for example, flexible batteries that are compact, occupy less space in the footwear, flexibly conform to varying contours of the footwear, can be easily accommodated at any location inside or outside the footwear, and can be easily replaced, without obstructing or injuring the user wearing the footwear and without causing damage to the batteries. The flexible energy storage devices disclosed herein provide a mechanical robustness to the ventilation apparatus that withstands operating environments. The flexible energy storage devices disclosed herein change shape in accordance with the varying contours of the footwear.

The ventilation apparatus disclosed herein comprises at least one flexible energy storage device, a switching unit, a pump, and a fluid diffuser. The flexible energy storage device is positioned at one or more preconfigured locations of the footwear, for example, at a location between an inner rear surface and an outer rear surface of the footwear, and/or at a location on an outer surface of the footwear. The flexible energy storage device comprises one or more substantially thin electric power layers that flexibly conform to the varying contours of the footwear and sustain deforming forces that arise during usage of the footwear. The flexible energy storage device stores and supplies electrical energy to the pump via the switching unit to actuate the pump. The flexible energy storage device is rechargeable and usable over extended periods of time. The switching unit is in electric communication with the flexible energy storage device and the pump. The switching unit selectively changes modes of operation of the pump. The modes of operation comprise, for example, a pump mode for pumping fluid into a cavity of the footwear, an exhaust mode for exhausting the fluid from the cavity of the footwear, and a termination mode for terminating the operation of the pump. The pump is fixedly attached to a predefined section, for example, an upper section of the footwear and is operably connected to the switching unit. When the pump receives electrical energy from the flexible energy storage device via the switching unit, the pump pumps fluid, for example, air, into and exhausts fluid, for example, air and water vapor, from the cavity of the footwear.

The fluid diffuser is operably connected to the pump and positioned within the cavity of the footwear. In an embodiment, the fluid diffuser comprises a feed pipe. The feed pipe is fixedly connected to and extends from the pump into the cavity of the footwear. The feed pipe transfers the fluid pumped from the pump to the cavity of the footwear during the pump mode and transfers the fluid in the cavity of the footwear to an ambient environment external to the footwear during the exhaust mode, for ventilating the footwear. In another embodiment, the fluid diffuser further comprises a diffusing member that is in fluid communication with the feed pipe. The diffusing member is positioned and attached proximal to a front end of the footwear in the cavity of the footwear. The diffusing member comprises one or more openings for allowing the fluid pumped from the pump through the feed pipe to be transferred into the cavity of the footwear during the pump mode, and for allowing the fluid in the cavity of the footwear to be transferred through the feed pipe to an ambient environment external to the footwear during the exhaust mode, for ventilating the footwear.

In another embodiment, the fluid diffuser further comprises a fluid distribution channel member fixedly attached within a sole of the footwear. The fluid distribution channel member comprises channels that are in fluid communication with the feed pipe of the fluid diffuser for allowing the fluid received from the feed pipe to be transferred to the cavity of the footwear during the pump mode and for allowing the fluid in the cavity of the footwear to be transferred through the feed pipe to the ambient environment external to the footwear during the exhaust mode, for ventilating the footwear. In another embodiment, the ventilation apparatus disclosed herein further comprises through holes configured on an insole of the footwear. The through holes of the insole are axially aligned with the channels of the fluid distribution channel member for allowing transfer of the fluid received by the channels of the fluid distribution channel member from the feed pipe to the cavity of the footwear during the pump mode and for allowing transfer of the fluid from the cavity of the footwear, through the channels of the fluid distribution channel member, into the feed pipe, and out to the ambient environment external to the footwear during the exhaust mode.

In another embodiment, the ventilation apparatus disclosed herein comprises two pumps, that is, a first pump fixedly attached to a predefined section, for example, the upper section of the footwear, and a second pump positioned within a sole of the footwear. The pumps pump fluid into and exhaust the fluid from the cavity of the footwear. The switching unit is in electric communication with the first pump and the second pump. In this embodiment, the switching unit selectively changes modes of operation of the first pump and the second pump. The modes of operation comprise, for example, a pump mode, an exhaust mode, and a termination mode. In this embodiment, the feed pipe of the fluid diffuser is fixedly connected to and extends from the first pump into the cavity of the footwear. The feed pipe transfers the fluid pumped from the first pump to the diffusing member that is in fluid communication with the feed pipe. The openings of the diffusing member allow the fluid pumped from the first pump through the feed pipe to be transferred into the cavity of the footwear proximal to the front end of the footwear for ventilating the footwear. The openings of the diffusing member further allow the fluid in the cavity of the footwear at the rear end of the footwear to be transferred via the second pump and through the feed pipe to an ambient environment external to the footwear for ventilating the footwear.

In one or more embodiments, related systems comprise circuitry for effecting the methods disclosed herein. The circuitry can be any combination of hardware, software, and/or firmware configured to effect the methods disclosed herein depending upon the design choices of a system designer. Also, various structural elements can be employed depending on the design choices of the system designer.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods, structures, and components disclosed herein. The description of a method step or a structure or a component referenced by a numeral in a drawing is applicable to the description of that method step or structure or component shown by that same numeral in any subsequent drawing herein.

DETAILED DESCRIPTION OF THE INVENTION

Figure 1:
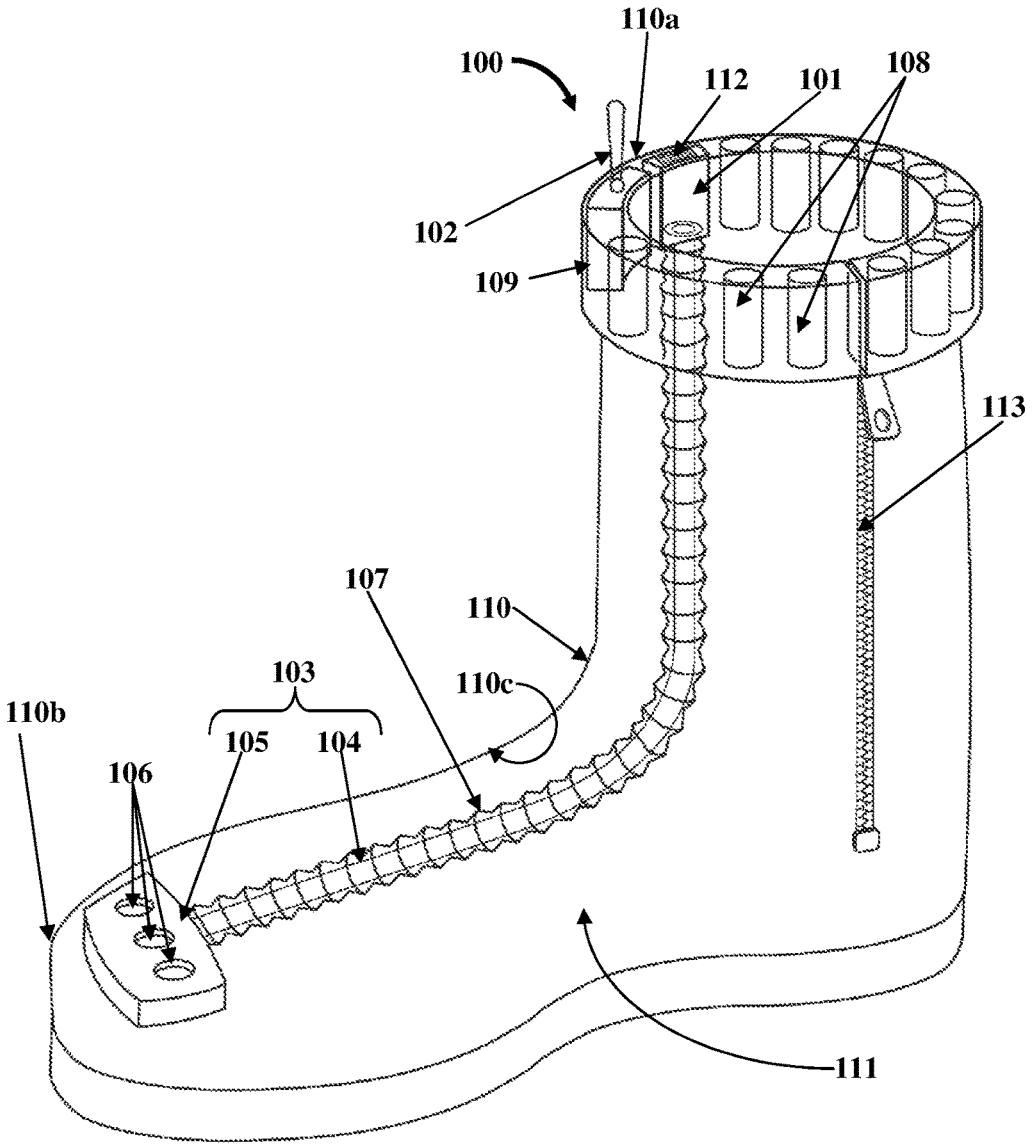
FIG. 1 exemplarily illustrates a right side perspective view of a ventilation apparatus for ventilating footwear.

FIG. 1 exemplarily illustrates a right side perspective view of a ventilation apparatus 100 for ventilating footwear 110, for example, shoes, sneakers, boots, high boots, etc. The ventilation apparatus 100 disclosed herein is a mechanical ventilation unit comprising a pump 101, a switching unit 102, and a fluid diffuser 103. The pump 101 is fixedly attached on a predefined section, for example, an upper section 110*a* of the footwear 110. The pump 101 is, for example, one of an electric pump, a piezoelectric pump, an electromechanical pump, etc. The pump 101 can be of any predefined size or shape and can be positioned on any section inside or outside the footwear 110. The pump 101 pumps fluid 201 directly from an ambient environment external to the footwear 110 into a cavity 111 of the footwear 110, and exhausts fluid 201 from the cavity 111 of the footwear 110 directly to the ambient environment external to the footwear 110 as exemplarily illustrated in FIGS. 2-3. As used herein, the term "fluid" refers to a substance, for example, a liquid and/or a gas, capable of flowing. The fluid 201 pumped into or exhausted out from the cavity 111 of the footwear 110 comprises, for example, air, water vapor, etc. Also, as used herein, the term "cavity" refers to an interior space defined by the footwear 110 where a foot of a user is inserted. Also, as used herein, "user" refers to a person who wears the footwear 110. The switching unit 102 is in electric communication with the pump 101. The switching unit 102 selectively changes modes of operation of the pump 101. The modes of operation comprise, for example, a pump mode for pumping the fluid 201 into the cavity 111 of the footwear 110, and an exhaust mode for exhausting the fluid 201 from the cavity 111 of the footwear 110. In an embodiment, the modes of operation of the pump 101 further comprise a termination mode for terminating the operation of the pump 101. The switching unit 102 can therefore be a two way switch or a three way switch depending on the number of modes of operation. The switching unit 102 enables actuation of the pump 101 at different times, for example, during rest, during movement, during any physical activity, during high temperature situations, while the user is in a warm environment, or at selected times for ventilating the footwear 110.

The fluid diffuser 103 is operably connected to the pump 101 and positioned within the cavity 111 of the footwear 110. The fluid diffuser 103 comprises a feed pipe 104 fixedly connected to and extending from the pump 101 into the cavity 111 of the footwear 110. The feed pipe 104 transfers the fluid 201 pumped from the pump 101 to the cavity 111 of the footwear 110 during the pump mode and further transfers the fluid 201 in the cavity 111 of the footwear 110 to an ambient environment external to the footwear 110 during the exhaust mode, for ventilating the footwear 110.

In an embodiment as exemplarily illustrated in FIG. 1, the fluid diffuser 103 further comprises a diffusing member 105 in fluid communication with the feed pipe 104. The feed pipe 104 is, for example, a small caliber pipe that provides an air tight connection between the pump 101 and the diffusing member 105. The diffusing member 105 is positioned and attached proximal to a front end 110*b* of the footwear 110 in the cavity 111 of the footwear 110. The diffusing member 105 comprising one or more openings 106 for allowing the fluid 201 pumped from the pump 101 through the feed pipe 104 to be transferred into the cavity 111 of the footwear 110 during the pump mode for ventilating the footwear 110. The openings 106 of the diffusing member 105 also allow the fluid 201 in the cavity 111 of the footwear 110 to be transferred through the feed pipe 104 to an ambient environment external to the footwear 110, via vents 112 configured on the pump 101, during the exhaust mode for ventilating the footwear 110. The feed pipe 104 and the diffusing member 105 are made, for example, of synthetic materials with elastic properties. In an embodiment, the fluid diffuser 103 further comprises a metallic tube 107 configured as a hose for enclosing and securing the feed pipe 104. The feed pipe 104 is enclosed within the metallic tube 107. The metallic tube 107 provides protection against crumpling of the feed pipe 104. The metallic tube 107 with the enclosed feed pipe 104 is positioned in recesses proximal to an inner surface 110*c* of the footwear 110.

The ventilation apparatus 100 disclosed herein further comprises one or more energy storage devices 108, for example, batteries positioned proximal to or in the predefined section, for example, the upper section 110*a* of the footwear 110. The energy storage devices 108 are operably connected to the pump 101. The energy storage devices 108 supply electrical energy to the pump 101 to actuate the pump 101. In an embodiment, the ventilation apparatus 100 disclosed herein further comprises an energy converter 109, for example, an electric current converter in electric communication with the energy storage devices 108 and the pump 101. In an embodiment, the energy converter 109 is positioned in an ankle section of the footwear 110. The energy converter 109 converts direct current received from the energy storage devices 108 to an alternating current to be supplied to the pump 101 to actuate the pump 101. In an embodiment, the energy storage devices 108 supply direct current to the pump 101 to actuate the pump 101. In an embodiment, the pump 101, the energy storage devices 108, and the energy converter 109 are positioned within a horseshoe shaped upper section 110*a* of the footwear 110 as exemplarily illustrated in FIG. 1. In another embodiment, the pump 101, the energy storage devices 108, and the energy converter 109 can be positioned at any convenient location inside or outside the footwear 110. A zipper 113 is fixedly attached to the footwear 110 for allowing the user to access the cavity 111 of the footwear 110 and insert the foot into the cavity 111 of the footwear 110.

Figure 2:
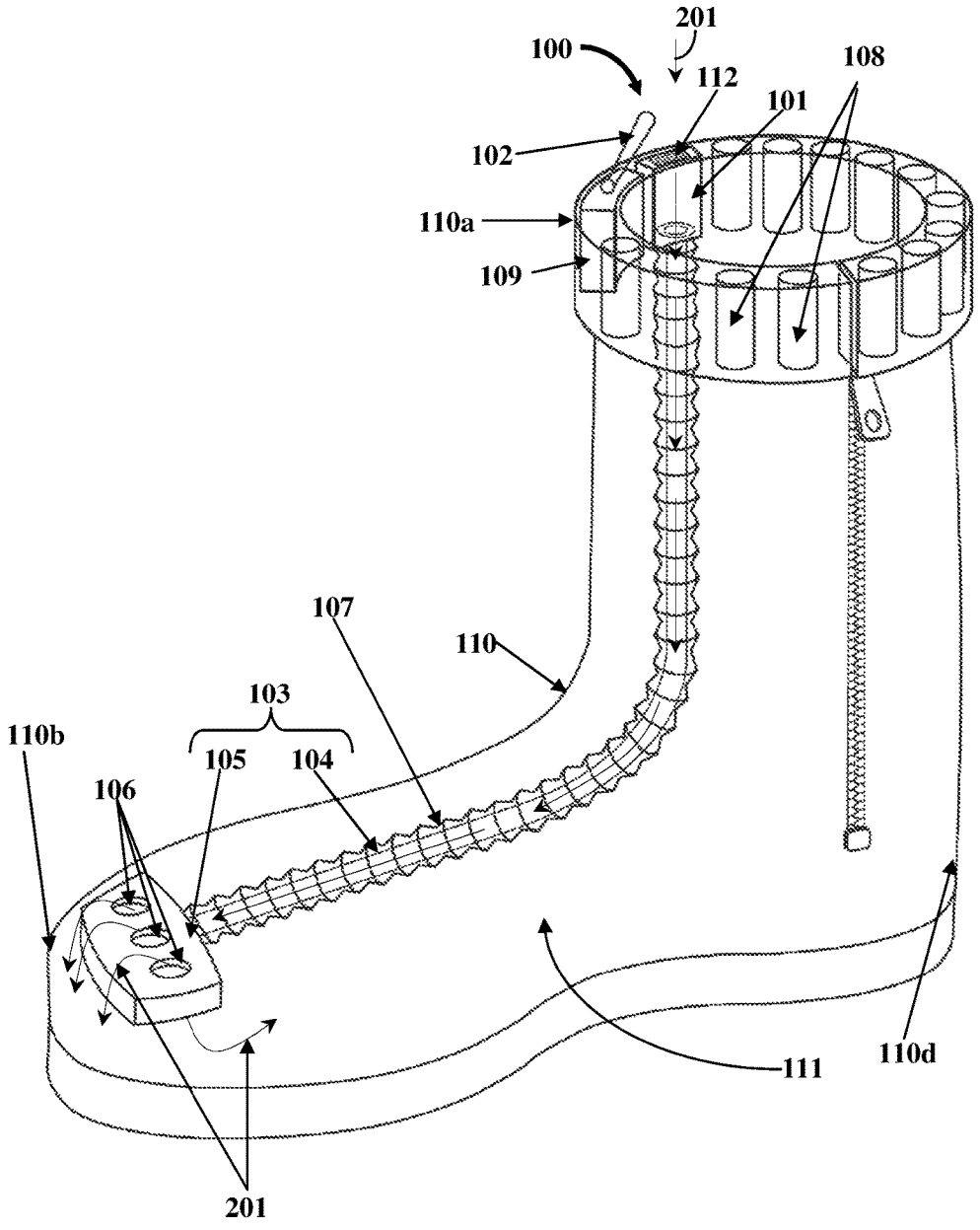
FIG. 2 exemplarily illustrates a right side perspective view of the ventilation apparatus, showing a pump mode of operation of the ventilation apparatus.

FIG. 2 exemplarily illustrates a right side perspective view of the ventilation apparatus 100, showing a pump mode of operation of the ventilation apparatus 100. In an embodiment, the switching unit 102 of the ventilation apparatus 100 is a three way switch for triggering the pump mode, the exhaust mode, and the termination mode of the pump 101. The pump 101 is elastically suspended in the upper section 110*a* of the footwear 110 and forms a rigid connection with the feed pipe 104 of the fluid diffuser 103. The pump 101 is used to pump fluid 201 into the footwear 110 or suction fluid 201 out of the footwear 110. The pump 101 is connected to the fluid diffuser 103 that transports fluid 201 in and out of the cavity 111 of the footwear 110. To reverse a direction of rotation of a motor (not shown) of the pump 101, the pump 101 is activated or energized through the switching unit 102, for example, the three way switch, which has an intermediate neutral position corresponding to the termination mode of the pump 101. The alternative positions of the switching unit 102 correspond to alternative directions of rotation of the motor of the pump 101.

The arrows directed through the pump 101 and through the fluid diffuser 103 shown in FIG. 2, indicate the direction of flow of the fluid 201 from the ambient environment into the cavity 111 of the footwear 110 in the pump mode of operation. Initially, on activation by the user, the switching unit 102 switches the pump 101 from the neutral position, that is, the termination mode to the pump mode. In the pump mode, the pump 101 pumps fluid 201 from the ambient environment external to the footwear 110 via the vents 112, and then into the cavity 111 of the footwear 110 via the fluid diffuser 103. The pumped fluid 201 from the pump 101 is transferred to the feed pipe 104, from where the pumped fluid 201 is further transferred to the diffusing member 105 that is distally connected to the feed pipe 104. In an embodiment, the feed pipe 104 is configured as a fluid dispersing pipe. The diffusing member 105 can be any type of diffuser, for example, a type of diffuser through which air is bubbled into water in aquariums. The fluid 201 received from the feed pipe 104 is transferred through the openings 106 of the diffusing member 105 into the cavity 111 of the footwear 110, for example, towards the front end 110*b* of the footwear 110 and then towards the rear end 110*d* of the footwear 110. The pumped fluid 201 is therefore circulated around the foot of a user wearing the footwear 110, thereby providing cooling around the foot of the user. The switching unit 102 can be turned on or off at any time, for example, when the user wears the footwear 110 for a long duration, when the user wearing the footwear 110 is in a warm air environment, when the user wearing the footwear 110 exercises, etc. The movements of the user's foot inside the footwear 110, for example, during working, walking, running, etc., further adds to the intermixing of warm fluid and the incoming pumped fluid 201 from the pump 101. On activation by the user, the switching unit 102 can then switch the pump 101 from the pump mode to the exhaust mode to exhaust the fluid 201 from the cavity 111 of the footwear 110 as disclosed in the detailed description of FIG. 3.

Figure 3:
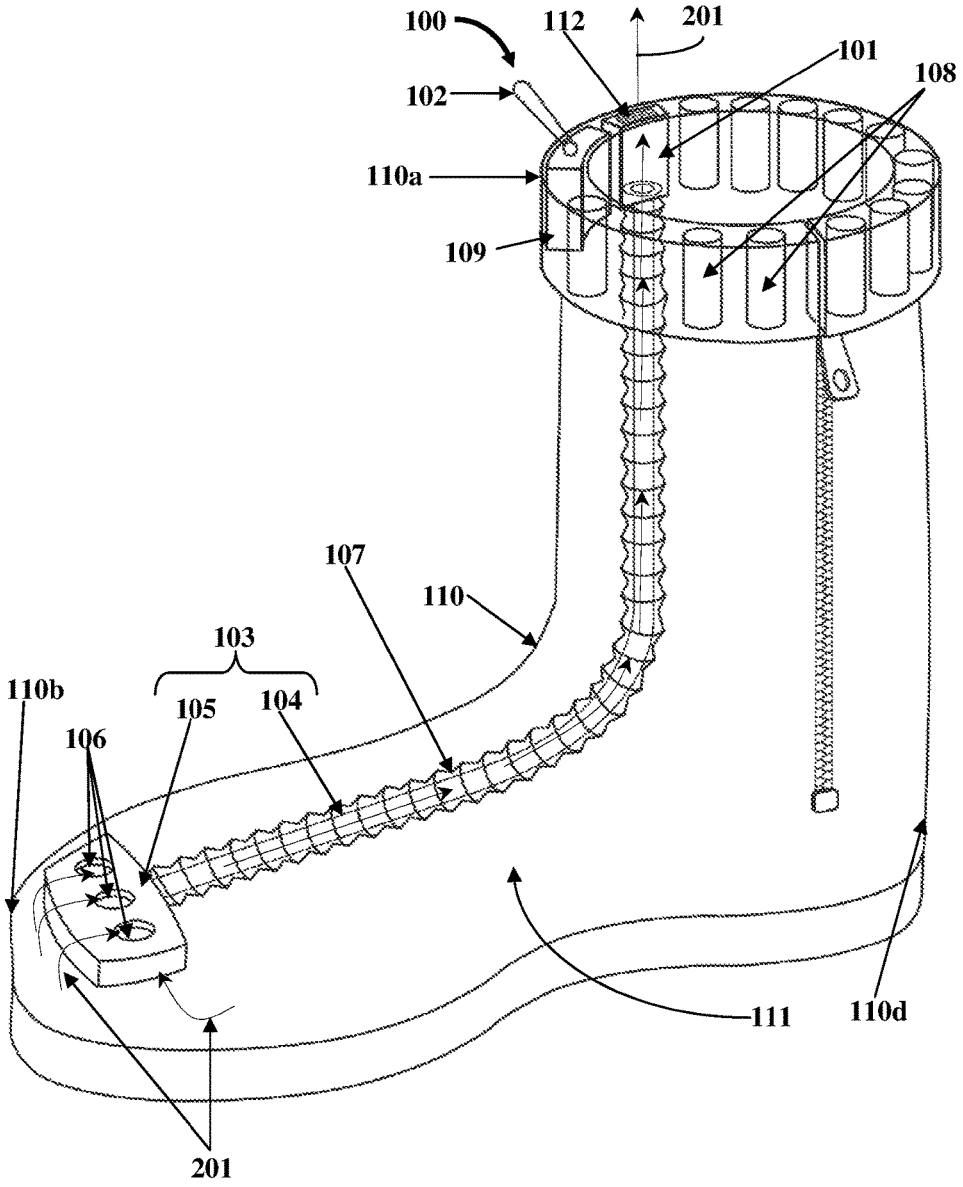
FIG. 3 exemplarily illustrates a right side perspective view of the ventilation apparatus, showing an exhaust mode of operation of the ventilation apparatus.

FIG. 3 exemplarily illustrates a right side perspective view of the ventilation apparatus 100, showing an exhaust mode of operation of the ventilation apparatus 100. The arrows directed from the cavity 111 of the footwear 110 and through the fluid diffuser 103 shown in FIG. 3, indicate the direction of flow of the fluid 201 from the cavity 111 of the footwear 110 to the ambient environment in the exhaust mode of operation. After the pump mode, the pump 101 is switched to the exhaust mode by reversing polarity of the voltage supplied by the energy storage devices 108 via the switching unit 102, or by changing the direction of rotation of the motor (not shown) of the pump 101, that is, by mechanical turning of the motor of the pump 101 between input and output connections of the motor. The pump 101 exhausts fluid 201 from the cavity 111 of the footwear 110 through the fluid diffuser 103. When the pump 101 is switched to the exhaust mode, exhaust fluid 201 from the cavity 111 of the footwear 110 is directed through the openings 106 of the diffusing member 105 of the fluid diffuser 103 and into the feed pipe 104, and then exhausted through the pump 101. The pump 101 exhausts the fluid 201 into the ambient environment external to the footwear 110 via the vents 112. The exhaust mode of operation ventilates the footwear 110 by exhausting the warm fluid 201 around the foot of a user wearing the footwear 110, thereby providing cooling around the user's foot.

Figure 4:
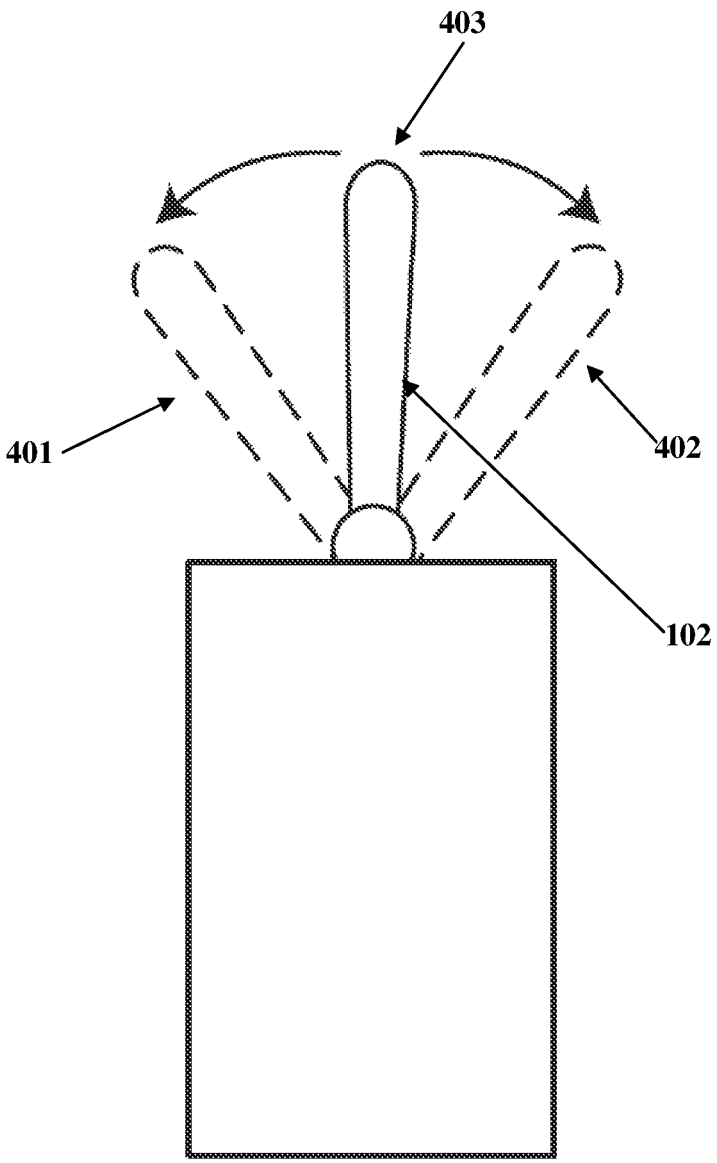
FIG. 4 exemplarily illustrates a front elevation view of a switching unit of the ventilation apparatus, showing the operation of the switching unit.

FIG. 4 exemplarily illustrates a front elevation view of the switching unit 102 of the ventilation apparatus 100 exemplarily illustrated in FIG. 1, showing the operation of the switching unit 102. The switching unit 102 selectively changes modes of operation, for example, the pump mode, the exhaust mode, and the termination mode of the pump 101 exemplarily illustrated in FIG. 1. The pump mode for pumping the fluid 201 exemplarily illustrated in FIG. 2, into the cavity 111 of the footwear 110 is activated when the switching unit 102 is moved to a first position 401. The exhaust mode for exhausting the fluid 201 exemplarily illustrated in FIG. 3, from the cavity 111 of the footwear 110 is activated when the switching unit 102 is moved to a second position 402. A third position 403 of the switching unit 102 exemplarily illustrated in FIG. 4, shows the termination mode of the pump 101 for deactivating the pump 101.

Figure 5:
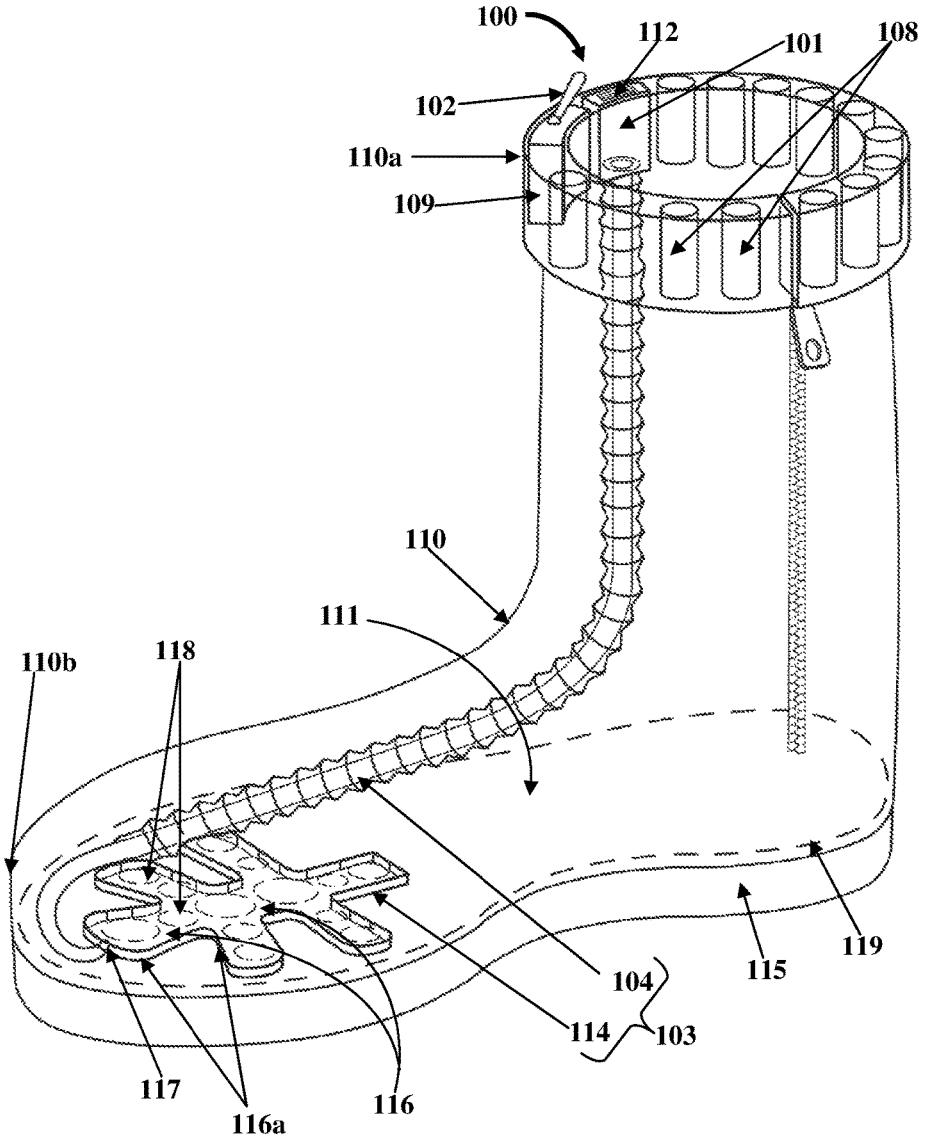
FIG. 5 exemplarily illustrates an embodiment of the ventilation apparatus for ventilating footwear.

FIG. 5 exemplarily illustrates an embodiment of the ventilation apparatus 100 for ventilating footwear 110. The ventilation apparatus 100 comprises the pump 101, the switching unit 102, the energy storage devices 108, and the energy converter 109 positioned, for example, on the upper section 110*a* of the footwear 110 as disclosed in the detailed description of FIG. 1. In an embodiment, in addition to the feed pipe 104, the fluid diffuser 103 of the ventilation apparatus 100 further comprises a fluid distribution channel member 114 fixedly attached within a sole 115 of the footwear 110. The fluid distribution channel member 114 comprises channels 116, in fluid communication with the feed pipe 104 of the fluid diffuser 103, for allowing the fluid 201 received from the feed pipe 104 exemplarily illustrated in FIG. 6, to be transferred to the cavity 111 of the footwear 110 during the pump mode and for allowing the fluid 201 in the cavity 111 of the footwear 110 to be transferred through the feed pipe 104 to the ambient environment external to the footwear 110 during the exhaust mode, for ventilating the footwear 110. In an embodiment as exemplarily illustrated in FIG. 5, the channels 116 are configured along multiple branches 116*a* of the fluid distribution channel member 114 for enhanced transfer of the fluid 201 to and from the cavity 111 of the footwear 110. The fluid 201 is transferred between the feed pipe 104 and the fluid distribution channel member 114 via a connection opening 117 positioned on the fluid distribution channel member 114.

In an embodiment, through holes 118 are configured on an insole 119 of the footwear 110. The through holes 118 of the insole 119 are axially aligned with the channels 116 of the fluid distribution channel member 114 for allowing the transfer of the fluid 201 received by the channels 116 of the fluid distribution channel member 114 from the feed pipe 104 to the cavity 111 of the footwear 110 during the pump mode and for allowing transfer of the fluid 201 from the cavity 111 of the footwear 110, through the channels 116 of the fluid distribution channel member 114, into the feed pipe 104, and out to the ambient environment external to the footwear 110 during the exhaust mode.

Figure 6:
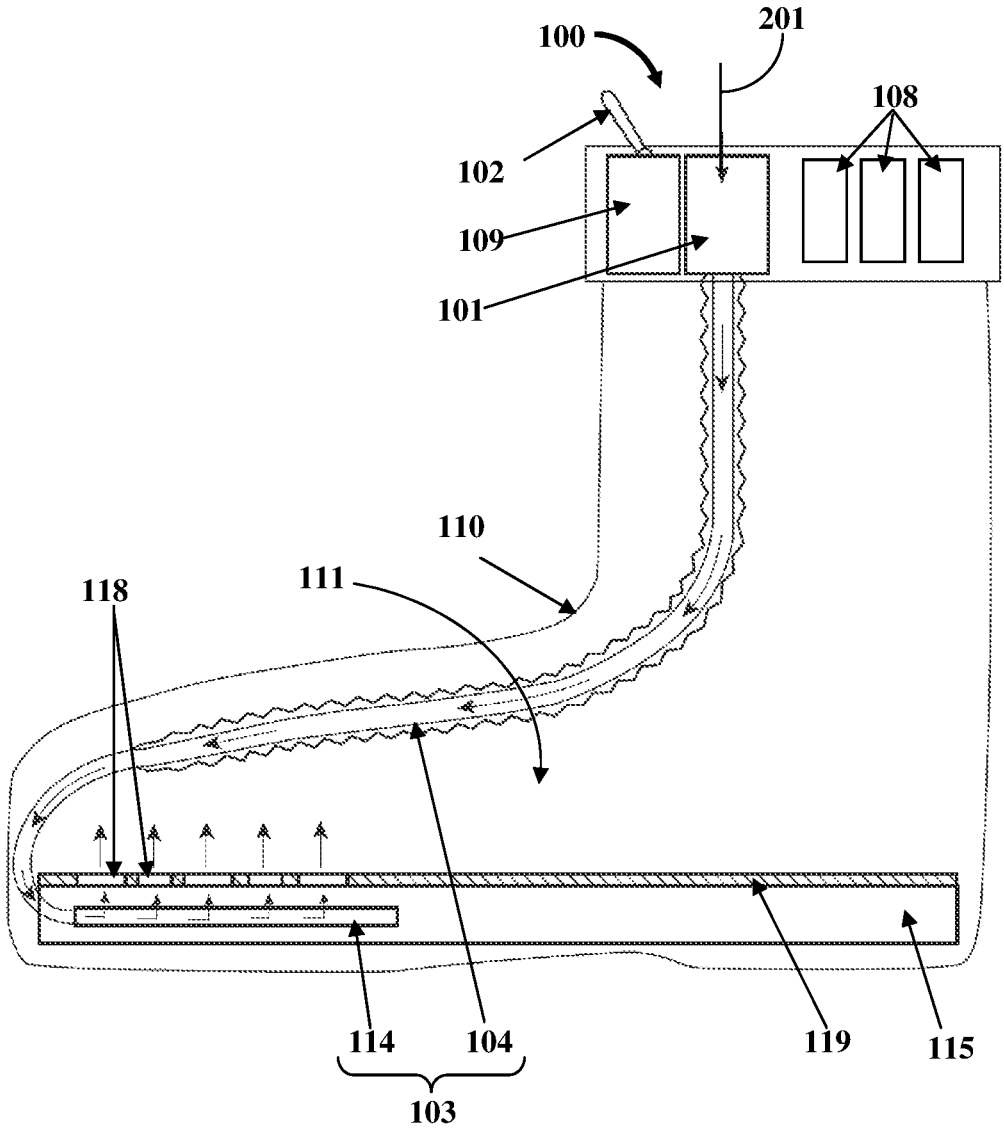
FIG. 6 exemplarily illustrates a right side elevation view of the embodiment of the ventilation apparatus shown in FIG. 5, showing a pump mode of operation of the ventilation apparatus.

FIG. 6 exemplarily illustrates a right side elevation view of the embodiment of the ventilation apparatus 100 shown in FIG. 5, showing a pump mode of operation of the ventilation apparatus 100. As exemplarily illustrated in FIG. 6, when a user wants to pump fluid 201 into the cavity 111 of the footwear 110 to ventilate the footwear 110, the user switches the pump 101 to the pump mode using the switching unit 102. The energy storage devices 108 supply electrical energy to the pump 101 via the switching unit 102 to actuate the pump 101. In the pump mode, the pump 101 starts pumping the fluid 201 from the ambient environment external to the footwear 110 through the vents 112 exemplarily illustrated in FIG. 5, and through the feed pipe 104, which is connected to the fluid distribution channel member 114 through the connection opening 117 exemplarily illustrated in FIG. 5. The fluid 201 from the feed pipe 104 enters the channels 116 of the fluid distribution channel member 114 through the connection opening 117. The fluid 201 is then transferred from the channels 116 of the fluid distribution channel member 114 to the cavity 111 of the footwear 110 through the through holes 118 of the insole 119.

Figure 7:
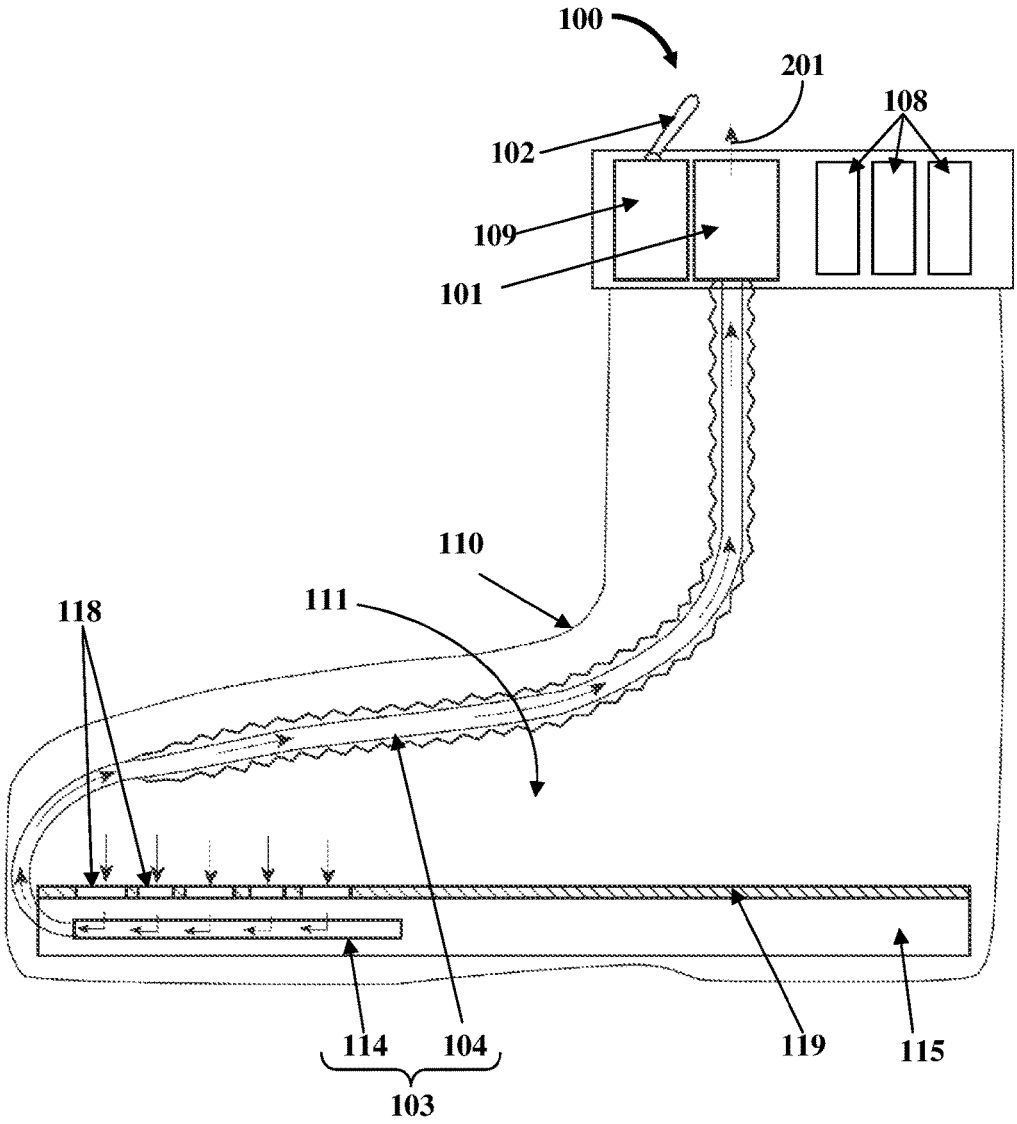
FIG. 7 exemplarily illustrates a right side elevation view of the embodiment of the ventilation apparatus shown in FIG. 5, showing an exhaust mode of operation of the ventilation apparatus.

FIG. 7 exemplarily illustrates a right side elevation view of the embodiment of the ventilation apparatus 100 shown in FIG. 5, showing an exhaust mode of operation of the ventilation apparatus 100. As exemplarily illustrated in FIG. 7, when a user wants to exhaust fluid 201 from the cavity 111 of the footwear 110, the user switches the pump 101 to the exhaust mode using the switching unit 102. The energy storage devices 108 supply electrical energy to the pump 101 via the switching unit 102 to actuate the pump 101. In the exhaust mode, the pump 101 suctions or exhausts the fluid 201 from inside the cavity 111 of the footwear 110 to the ambient environment external to the footwear 110. The fluid 201 from the cavity 111 of the footwear 110 is first transferred through the through holes 118 of the insole 119 and into the channels 116 of the fluid distribution channel member 114 positioned inside the sole 115 below the insole 119 as exemplarily illustrated in FIG. 5. The fluid 201 is then transferred from the channels 116 of the fluid distribution channel member 114 to the feed pipe 104 via the connection opening 117 exemplarily illustrated in FIG. 5. The feed pipe 104 then transfers the fluid 201 out to the ambient environment external to the footwear 110 through the vents 112 positioned on the pump 101 exemplarily illustrated in FIG. 5.

Figure 8:
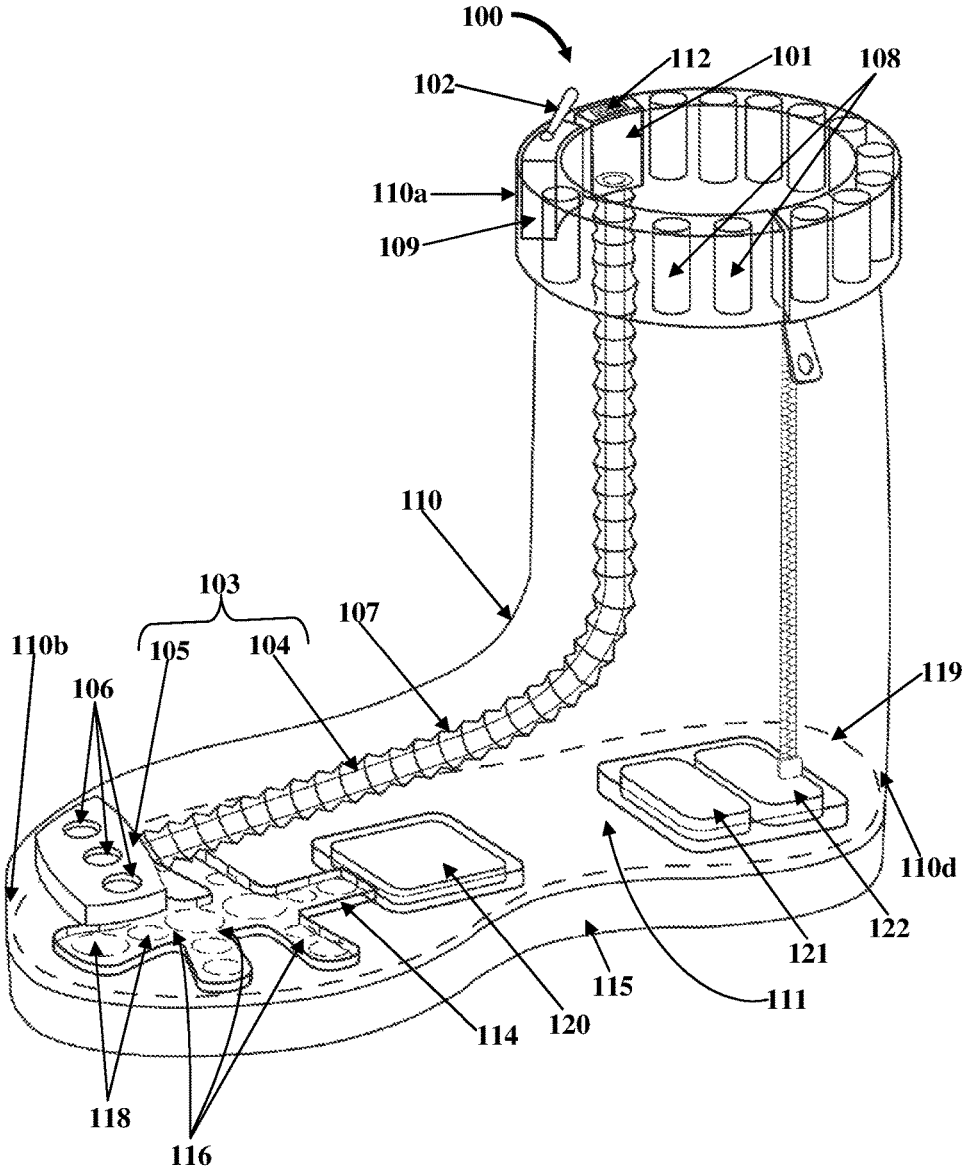
FIG. 8 exemplarily illustrates an embodiment of the ventilation apparatus for ventilating footwear.

FIG. 8 exemplarily illustrates an embodiment of the ventilation apparatus 100 for ventilating footwear 110. In this embodiment, the ventilation apparatus 100 comprises pumps 101 and 120, the switching unit 102, and the fluid diffuser 103. The pumps 101 and 120 comprise a first pump 101 fixedly attached on a predefined section, for example, the upper section 110*a* of the footwear 110, and a second pump 120 positioned within a sole 115 of the footwear 110. The second pump 120 is, for example, centrally positioned on the sole 115 of the footwear 110 as exemplarily illustrated in FIG. 8. The pumps 101 and 120 are, for example, piezoelectric pumps, electromechanical pumps, etc. The pumps 101 and 120 pump fluid 201 into the cavity 111 of the footwear 110 and exhaust the fluid 201 from the cavity 111 of the footwear 110 as exemplarily illustrated in FIGS. 10-11. The switching unit 102 is in electric communication with the first pump 101 and the second pump 120. The switching unit 102 selectively changes modes of operation of the first pump 101 and the second pump 120. The modes of operation comprise a pump mode and an exhaust mode. In an embodiment, the modes of operation further comprise a termination mode. In an embodiment, the pumps 101 and 120 are interlocked, so that when the switching unit 102 actuates one pump 101 into the exhaust mode or a suction mode, the other pump 120 starts to pump in the pump mode and vice versa. In another embodiment, when the switching unit 102 switches one pump 101 to the pump mode, the other pump 120 also operates in the pump mode, and when the switching unit 102 switches one pump 101 to the exhaust mode or a suction mode, the other pump 120 also operates in the exhaust mode.

The fluid diffuser 103 is operably connected to the first pump 101 and the second pump 120 within the cavity 111 of the footwear 110. In this embodiment, the fluid diffuser 103 comprises the feed pipe 104 and the diffusing member 105. The feed pipe 104 is fixedly connected to and extends from the first pump 101 into the cavity 111 of the footwear 110. The feed pipe 104 transfers the fluid 201 pumped from the first pump 101 to the diffusing member 105 that is in fluid communication with the feed pipe 104. The diffusing member 105 is positioned and attached proximal to a front end 110*b* of the footwear 110 in the cavity 111 of the footwear 110. The diffusing member 105 comprises one or more openings 106 that allow the fluid 201 pumped from the first pump 101 through the feed pipe 104 to be transferred into the cavity 111 of the footwear 110, proximal to the front end 110*b* of the footwear 110, and allow the fluid 201 in the cavity 111 of the footwear 110 at the rear end 110*d* of the footwear 110 to be transferred via the second pump 120 and through the feed pipe 104 to an ambient environment external to the footwear 110, for ventilating the footwear 110.

In this embodiment, the fluid diffuser 103 further comprises a fluid distribution channel member 114 fixedly attached within the sole 115 of the footwear 110. The fluid distribution channel member 114 is operably connected to and in fluid communication with the second pump 120 within the sole 115 of the footwear 110. The fluid distribution channel member 114 comprises channels 116 that are in fluid communication with the openings 106 of the diffusing member 105 via through holes 118 configured on the insole 119 of the footwear 110, for allowing the fluid 201 received from the openings 106 of the diffusing member 105 to be transferred to the second pump 120, and for allowing the fluid 201 pumped by the second pump 120 to be transferred to the openings 106 of the diffusing member 105, into the feed pipe 104, and out to the ambient environment external to the footwear 110 via the first pump 101, for ventilating the footwear 110. The channels 116 of the fluid distribution channel member 114 allow unobstructed passage of fluid 201, for example, air to and from the second pump 120. The ventilation apparatus 100 further comprises an energy storage device 121 and an energy converter 122 as disclosed in the detailed description of FIG. 9.

Figure 9:
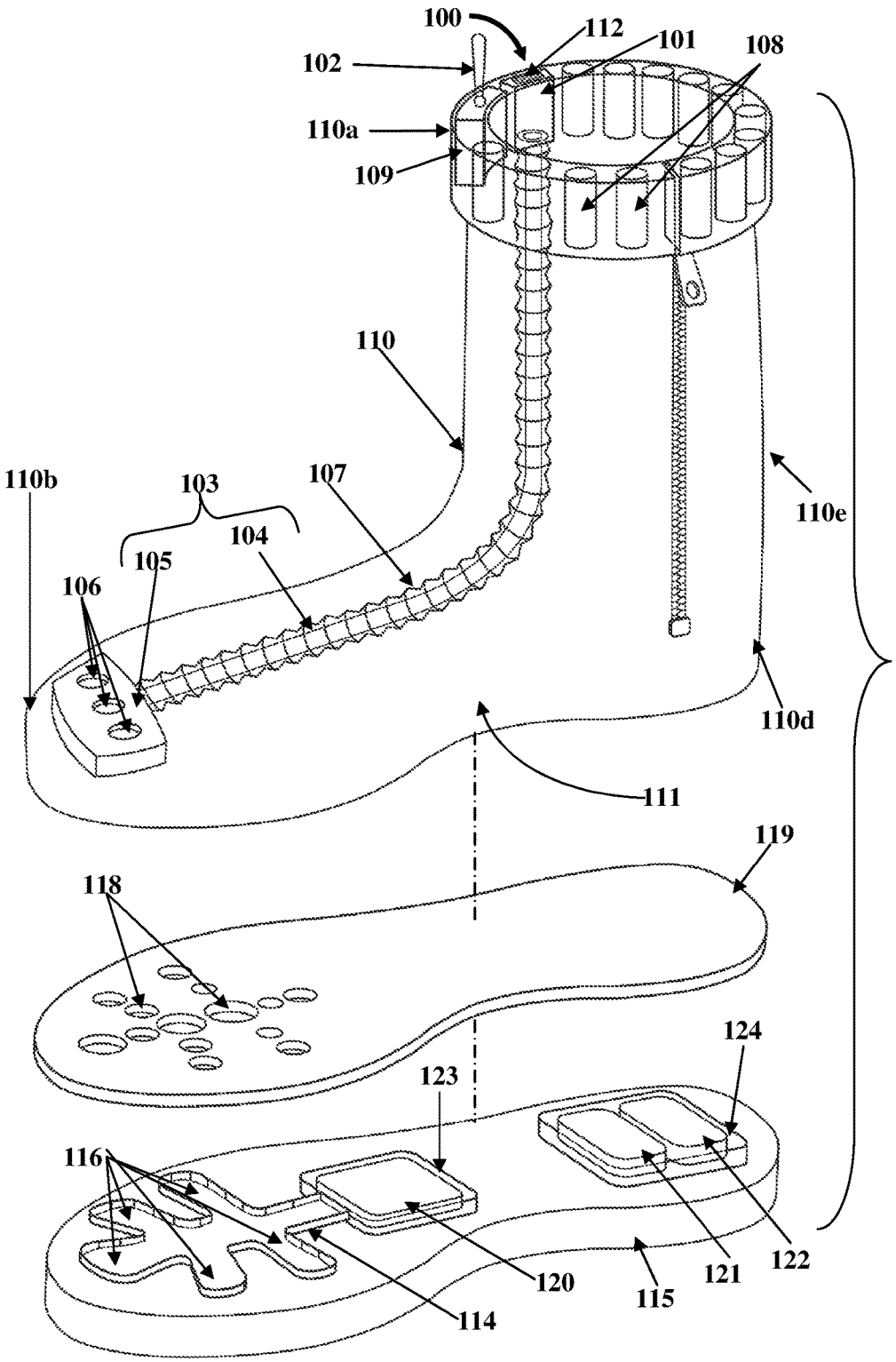
FIG. 9 exemplarily illustrates an exploded view of the embodiment of the ventilation apparatus shown in FIG. 8.

FIG. 9 exemplarily illustrates an exploded view of the embodiment of the ventilation apparatus 100 shown in FIG. 8. The exploded view shows an upper portion 110*e* of the footwear 110, the insole 119 of the footwear 110, and the sole 115 of the footwear 110. As exemplarily illustrated in FIG. 9, the upper portion 110*e* of the footwear 110 accommodates the first pump 101, the switching unit 102, the energy storage devices 108, the energy converter 109, and the feed pipe 104 and the diffusing member 105 of the fluid diffuser 103. The energy storage devices 108, for example, batteries are operably connected to the first pump 101 for supplying electrical energy to the first pump 101 to actuate the first pump 101. The energy converter 109 is in electric communication with the energy storage devices 108 and the first pump 101. The energy converter 109 converts direct current received from the energy storage devices 108 to an alternating current to be supplied to the first pump 101 to actuate the first pump 101.

The upper portion 110*e* of the footwear 110 is removably attached to the insole 119 of the footwear 110. The insole 119 of the footwear 110 is attached to the sole 115 of the footwear 110. The sole 115 of the footwear 110 accommodates an encasing 123 that holds the second pump 120, and another encasing 124 that holds another energy storage device 121, for example, a battery, and another energy converter 122. The encasings 123 and 124 are rigid protective frames that protect the second pump 120, and the energy storage device 121 and the energy converter 122 respectively. The energy storage device 121 is operably connected to the second pump 120 for supplying electrical energy to the second pump 120 to actuate the second pump 120. The energy converter 122, for example, an electric current converter, is in electric communication with the energy storage device 121 and the second pump 120. The energy converter 122 converts direct current received from the energy storage device 121 to an alternating current to be supplied to the second pump 120 to actuate the second pump 120. In an embodiment, the energy storage device 121 supplies direct current to the second pump 120 to actuate the second pump 120. The second pump 120, and the energy storage device 121 and the energy converter 122 which are subjected to stress during walking, are mounted inside their respective encasings 123 and 124, which are elastically suspended inside the sole 115 of the footwear 110.

The second pump 120 is operably connected to the fluid distribution channel member 114 within the sole 115 of the footwear 110. In this embodiment, the through holes 118 configured on the insole 119 of the footwear 110 are axially aligned with the channels 116 of the fluid distribution channel member 114 for allowing transfer of the fluid 201 received from the openings 106 of the diffusing member 105 to the channels 116 of the fluid distribution channel member 114 for transfer of the fluid 201 to the second pump 120 as exemplarily illustrated in FIG. 10, and for allowing transfer of the fluid 201 pumped by the second pump 120 to the openings 106 of the diffusing member 105 via the channels 116 of the fluid distribution channel member 114, into the feed pipe 104, and out to the ambient environment external to the footwear 110 via the first pump 101 as exemplarily illustrated in FIG. 11.

Figure 10:
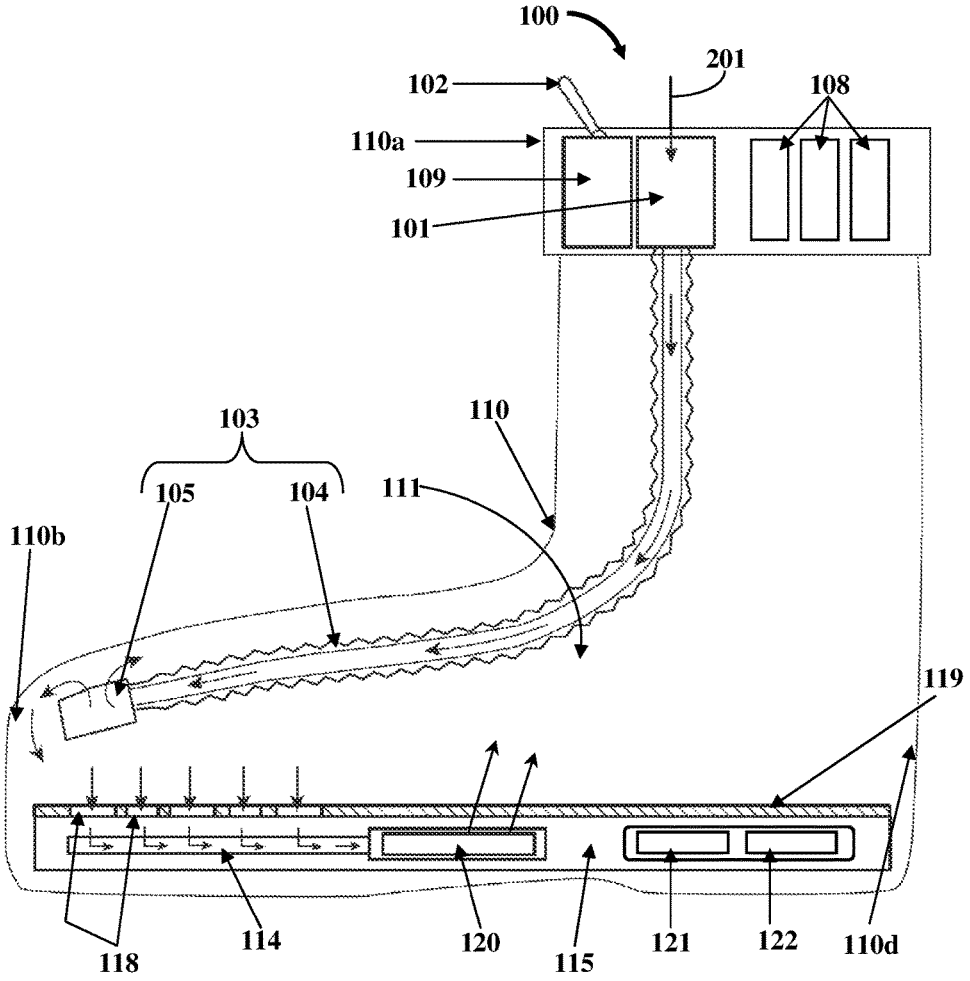
FIG. 10 exemplarily illustrates a right side elevation view of the embodiment of the ventilation apparatus shown in FIG. 8, showing a first pump in a pump mode and a second pump in an exhaust mode.

FIG. 10 exemplarily illustrates a right side elevation view of the embodiment of the ventilation apparatus 100 shown in FIG. 8, showing the first pump 101 in a pump mode and the second pump 120 in an exhaust mode. In an example, when a user wants to ventilate the cavity 111 of the footwear 110 by pumping fluid 201 into the cavity 111 of the footwear 110, the user activates the switching unit 102 to switch the first pump 101 to the pump mode and the second pump 120 to the exhaust mode. In the pump mode, the first pump 101 pumps fluid 201, for example, air from the ambient environment external to the footwear 110, into the cavity 111 of the footwear 110 through the fluid diffuser 103. The fluid 201 pumped from the first pump 101 is transferred to the diffusing member 105 of the fluid diffuser 103 through the feed pipe 104 of the fluid diffuser 103. The fluid 201 is then transferred to the cavity 111 proximal to the front end 110*b* of the footwear 110 through the openings 106 of the diffusing member 105. In the exhaust mode, the second pump 120 suctions a portion of the fluid 201 from the front end 110*b* of the footwear 110 and transfers the suctioned portion of the fluid 201 to the rear end 110*d* of the footwear 110. The fluid 201 is suctioned and transferred from the cavity 111 proximal to the front end 110*b* of the footwear 110 to the second pump 120 via the through holes 118 on the insole 119 and the channels 116 of the fluid distribution channel member 114 exemplarily illustrated in FIGS. 8-9.

Figure 11:
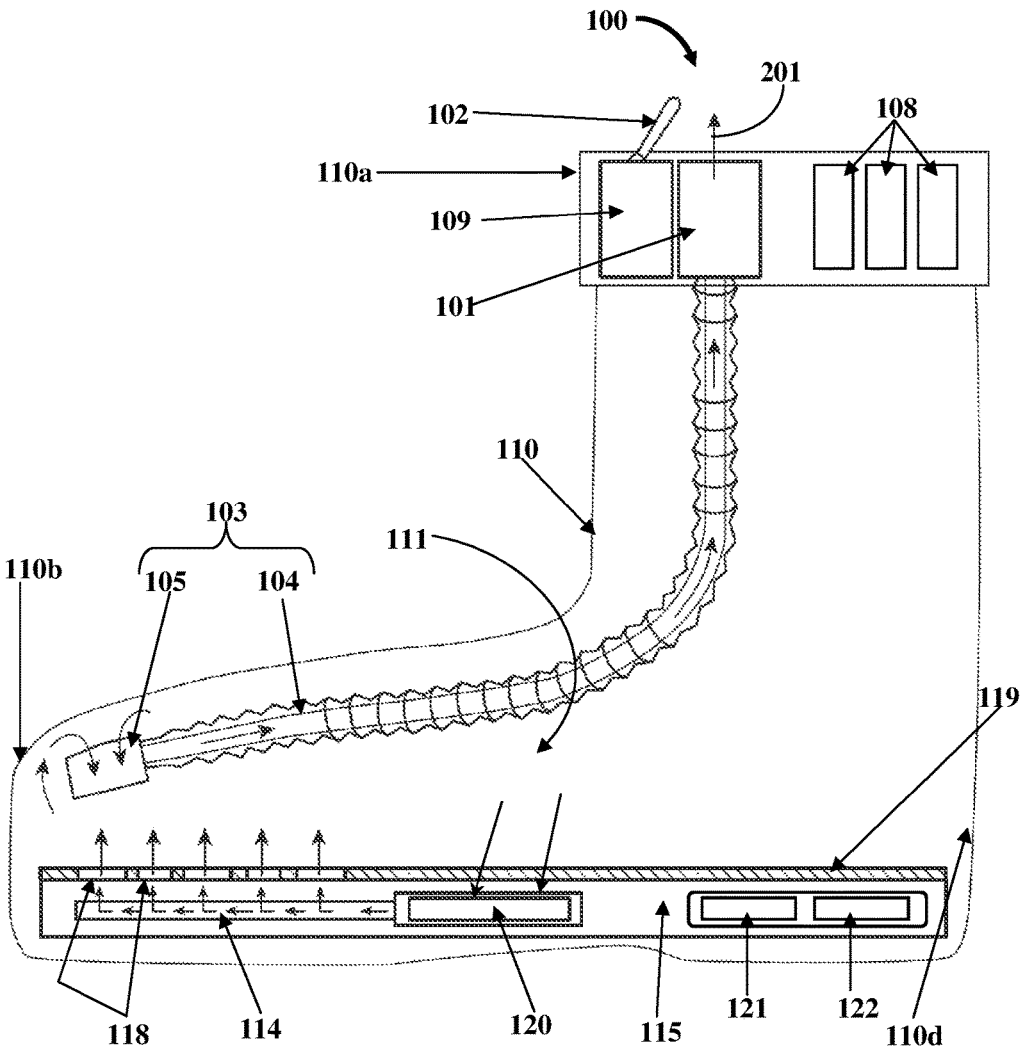
FIG. 11 exemplarily illustrates a right side elevation view of the embodiment of the ventilation apparatus shown in FIG. 8, showing the first pump in an exhaust mode and the second pump in a pump mode.

FIG. 11 exemplarily illustrates a right side elevation view of the embodiment of the ventilation apparatus 100 shown in FIG. 8, showing the first pump 101 in an exhaust mode and the second pump 120 in a pump mode. In another example, when a user wants to ventilate the cavity 111 of the footwear 110 by exhausting fluid 201, for example, air and water vapor from the cavity 111 of the footwear 110, the user activates the switching unit 102 to switch the first pump 101 to the exhaust mode and the second pump 120 to the pump mode. The first pump 101 is switched to the exhaust mode by reversing the polarity of the voltage supplied by the energy storage devices 108 via the switching unit 102. In the pump mode, the second pump 120 pumps the fluid 201 from the rear end 110*d* of the footwear 110 through the channels 116 of the fluid distribution channel member 114 and through the through holes 118 on the insole 119 exemplarily illustrated in FIGS. 8-9, towards the front end 110*b* of the footwear 110 as exemplarily illustrated in FIG. 11. In the exhaust mode, the first pump 101 further suctions the fluid 201 from the cavity 111 proximal to the front end 110*b* of the footwear 110 through the openings 106 of the diffusing member 105 and the feed pipe 104 and exhausts the fluid 201 to the ambient environment external to the footwear 110.

Figure 12:
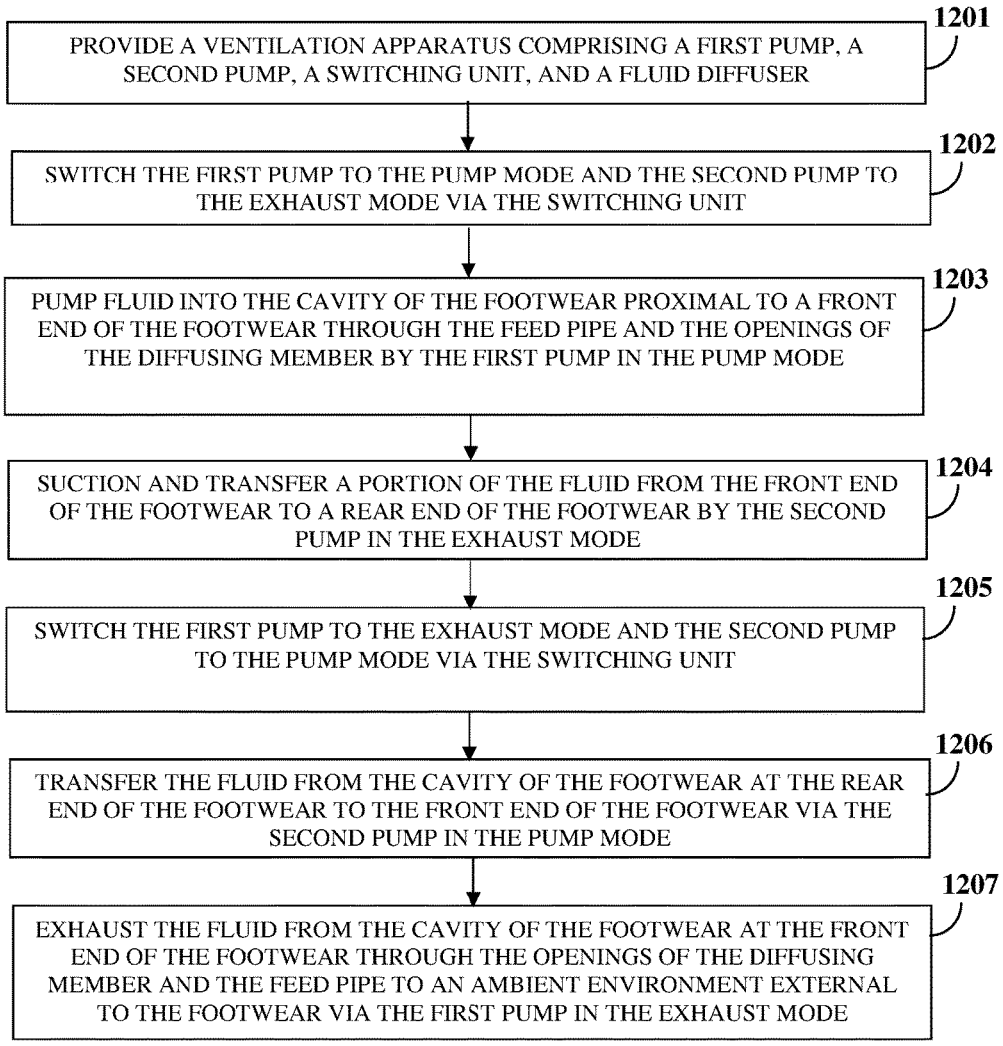
FIG. 12 exemplarily illustrates a method for ventilating footwear.

FIG. 12 exemplarily illustrates a method for ventilating footwear 110 exemplarily illustrated in FIGS. 8-9. The ventilation apparatus 100 comprising the first pump 101 and the second pump 120, the switching unit 102, and the fluid diffuser 103 as exemplarily illustrated in FIGS. 8-9, is provided 1201. The switching unit 102 switches 1202 the first pump 101 to the pump mode and the second pump 120 to the exhaust mode. The first pump 101 in the pump mode pumps 1203 the fluid 201, for example, air from the ambient environment external to the footwear 110 into the cavity 111 of the footwear 110 proximal to the front end 110*b* of the footwear 110 through the feed pipe 104 and the openings 106 of the fluid diffuser 103 as exemplarily illustrated in FIG. 10. The fluid distribution channel member 114 comprising the channels 116 in fluid communication with the openings 106 of the diffusing member 105 via the through holes 118 of the insole 119 of the footwear 110 exemplarily illustrated in FIGS. 8-9, transfer the fluid 201 received from the openings 106 of the diffusing member 105 to the second pump 120. The second pump 120 in the exhaust mode suctions and transfers 1204 a portion of the fluid 201 from the front end 110*b* of the footwear 110 to a rear end 110*d* of the footwear 110. Replacing the fluid exhausted from the cavity 111 of the footwear 110 with the fluid 201, for example, air from the ambient environment ventilates the cavity 111 inside the footwear 110.

The switching unit 102 then switches 1205 the first pump 101 to the exhaust mode and the second pump 120 to the pump mode. In the pump mode, the second pump 120 transfers 1206 the fluid 201 from the cavity 111 of the footwear 110 at the rear end 110*d* of the footwear 110 to the front end 110*b* of the footwear 110 as exemplarily illustrated in FIG. 11. The channels 116 of the fluid distribution channel member 114 transfer the fluid 201 pumped by the second pump 120 to the openings 106 of the diffusing member 105 via the through holes 118 of the insole 119 of the footwear 110. In the exhaust mode, the first pump 101 exhausts 1207 the fluid 201 from the cavity 111 of the footwear 110 at the front end 110*b* of the footwear 110 through the openings 106 of the diffusing member 105 and the feed pipe 104 to the ambient environment external to the footwear 110. The first pump 101 and the second pump 120 are selectively switched to the pump mode and the exhaust mode to ventilate the footwear 110. The switching unit 102 switches the first pump 101 and the second pump 120 to the termination mode for terminating the operation of the first pump 101 and the second pump 120.

Figure 13:
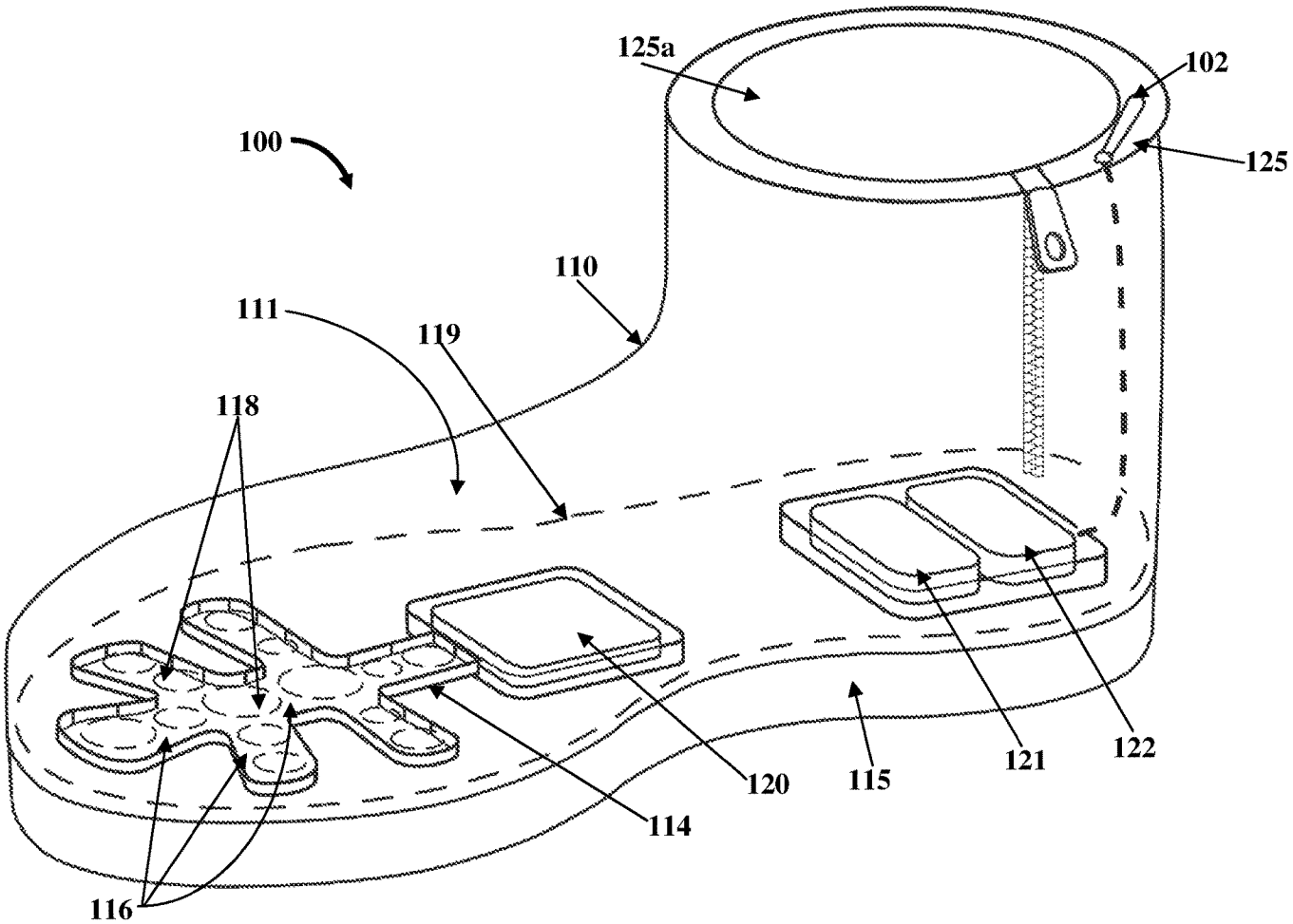
FIG. 13 exemplarily illustrates an embodiment of the ventilation apparatus for ventilating footwear of a low height.

FIG. 13 exemplarily illustrates an embodiment of the ventilation apparatus 100 for ventilating footwear 110 of a low height. In this embodiment, the ventilation apparatus 100 is configured to operate without the first pump 101, the feed pipe 104, and the diffusing member 105 exemplarily illustrated in FIGS. 8-9. The ventilation apparatus 100, in this embodiment, comprises a switching unit 102, a pump 120, the fluid distribution channel member 114 with the channels 116, the energy storage device 121, and the energy converter 122. The switching unit 102 is positioned on a collar 125 of the footwear 110 as exemplarily illustrated in FIG. 13. The pump 120, the fluid distribution channel member 114 with the channels 116, the energy storage device 121, and the energy converter 122 are positioned below the insole 119 of the footwear 110, inside the sole 115 of the footwear 110. The pump 120 is centrally positioned within the sole 115 of the footwear 110, while the energy storage device 121 and the energy converter 122 are positioned proximal to the rear end 110*d* of the footwear 110. The insole 119 of the footwear 110 is positioned above the sole 115 of the footwear 110 and comprises through holes 118 axially aligned with the channels 116 of the fluid distribution channel member 114. The switching unit 102 is electrically connected to the energy storage device 121 and the energy converter 122 to actuate the pump 120 in a pump mode and an exhaust mode.

During the exhaust mode, the switching unit 102 actuates the pump 120 to exhaust the fluid from the cavity 111 of the footwear 110. The exhaust fluid pumped by the pump 120 enters the channels 116 of the fluid distribution channel member 114 and exits the channels 116 into the through holes 118 of the insole 119. The fluid is further exhausted out from the through holes 118 of the insole 119 to the ambient environment external to the footwear 110 through an opening 125*a* defined by the collar 125 of the footwear 110 exemplarily illustrated in FIG. 13. During the pump mode, the pump 120 pumps the fluid from the ambient environment external to the footwear 110 in through the opening 125*a* of the footwear 110, through the through holes 118 of the insole 119, through the channels 116 of the fluid distribution channel member 114, and into the cavity 111 of the footwear 110. In this embodiment, the ventilation or cooling of a user's foot inserted into the cavity 111 of the footwear 110 is performed due to forced air movement around the foot by the pump 120.

Figure 14A:
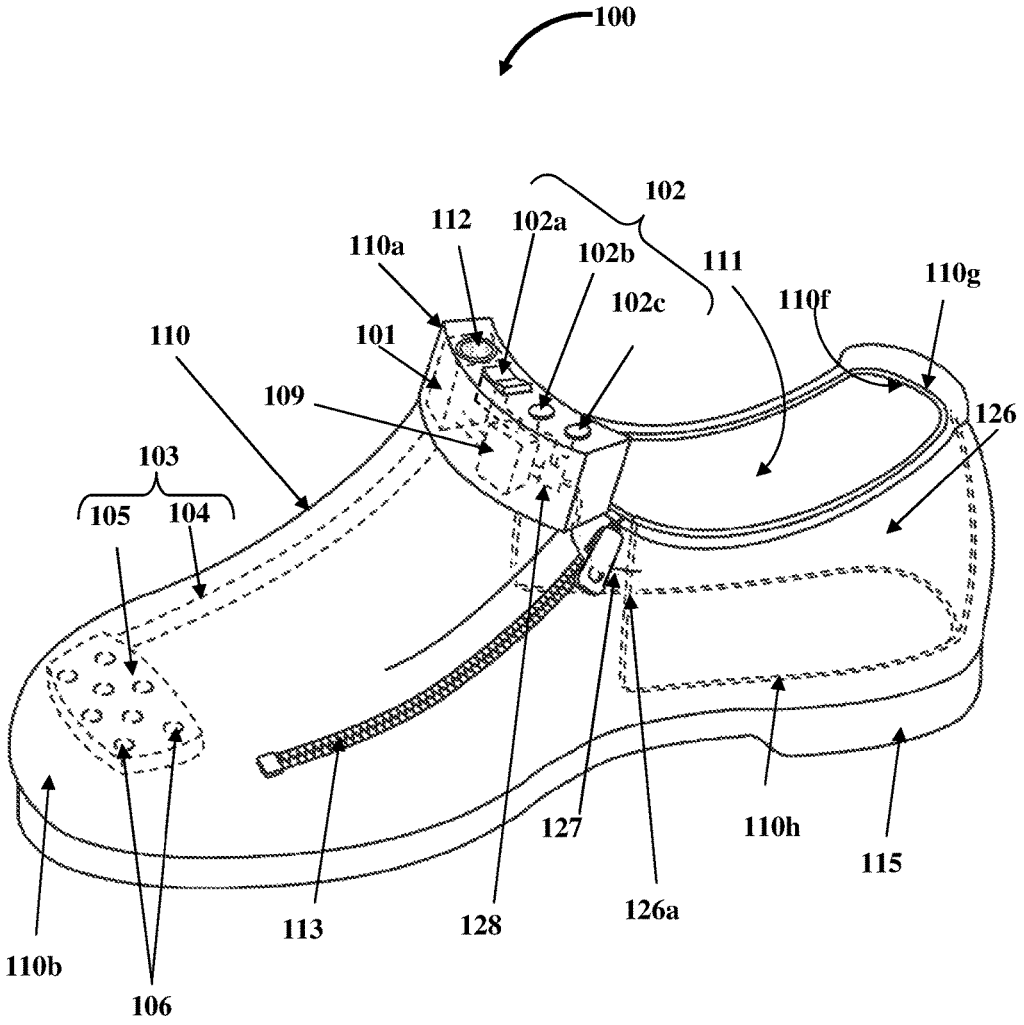
FIG. 14A exemplarily illustrates a right side perspective view of an embodiment of the ventilation apparatus for ventilating footwear.
Figure 14B:
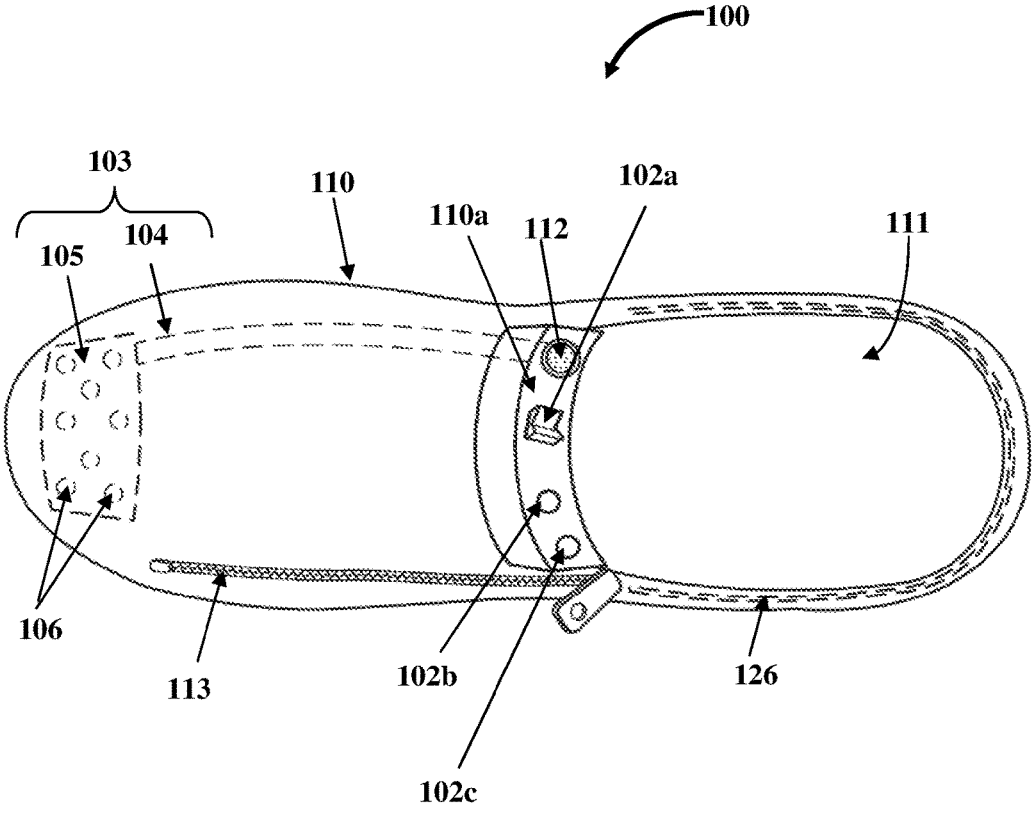
FIG. 14B exemplarily illustrates a top plan view of the embodiment of the ventilation apparatus shown in FIG. 14A, for ventilating footwear.

FIGS. 14A-14B exemplarily illustrate a right side perspective view and a top plan view respectively, of an embodiment of the ventilation apparatus 100 for ventilating footwear 110. The ventilation apparatus 100 disclosed herein is integrated into the footwear 110 having a zipper 113 as exemplarily illustrated in FIGS. 14A-14B. In this embodiment, the ventilation apparatus 100 comprises at least one flexible energy storage device 126, a pump 101, a switching unit 102, and a fluid diffuser 103. As used herein, "flexible energy storage device" refers to a thin film flexible battery composed of substantially thin materials having thicknesses measured in nanometers or micrometers. These thin materials are integrated to produce a thin flexible energy storage device 126 having a thickness of, for example, about 0.4 millimeters (mm) to about 0.5 mm. The flexible energy storage device 126 comprises one or more substantially thin electric power layers of flexible components that flexibly conform to varying contours of the footwear 110 and sustain deforming forces that arise during usage of the footwear 110. Footwear 110, for example, high boots provide a substantially vast space for positioning one or more flexible energy storage devices 126. The flexible energy storage device 126 can be fabricated into different shapes and sizes by different methods for positioning in the footwear 110. For example, in one method, polymer binders are used to fabricate composite electrodes of the flexible energy storage device 126 where conductive additives are added to enhance conductivity of the composite electrodes. Electrode materials can be printed or coated onto flexible substrates to fabricate the flexible energy storage device 126. Cells are assembled into flexible packaging materials to maintain bendability in the flexible energy storage device 126. In other methods, an electrode suspension is filtered through filters to form free-standing films that constitute the flexible energy storage device 126, or a flexible matrix is used to hold electrode materials that constitute the flexible energy storage device 126. The flexible energy storage device 126 is compact, occupies less space in the footwear 110, flexibly conforms to varying contours of the footwear 110, can be easily accommodated at any location inside or outside the footwear 110, and can be easily replaced, without obstructing or injuring a user wearing the footwear 110 and without causing damage to the flexible energy storage device 126.

The flexible energy storage device 126 disclosed herein is a compact flexible structure capable of conforming to surfaces of different profiles. The flexible energy storage device 126 is, for example, a flexible lithium battery made of a lithium polymer such as the lithium polymer battery of BrightVolt Inc., Fla., USA, the flexible lithium ion battery of Panasonic Corporation, Japan, etc. The substrates of the flexible energy storage device 126 are flat and thin, unlike cylindrical surfaces or thick rectangular surfaces of conventional energy storage devices. The flexible energy storage device 126 regains its original shape upon bending, deforming, etc., because of the elasticity of the flexible energy storage device 126. Because of this elasticity, the flexible energy storage device 126 can be accommodated in places with space restrictions, for example, in footwear 110 without hampering the functionality of the flexible energy storage device 126, thereby occupying less space.

The flexible energy storage device 126 of the ventilation apparatus 100 disclosed herein is positioned at one or more of multiple preconfigured locations of the footwear 110. In an embodiment as exemplarily illustrated in FIGS. 14A-14B, the flexible energy storage device 126 is positioned in a compartment 110*h* formed between an inner rear surface 110*f* and an outer rear surface 110*g* of the footwear 110. In another embodiment (not shown), the flexible energy storage device 126 is positioned in the sole 115 of the footwear 110. In another embodiment (not shown), the flexible energy storage device 126 is positioned in the upper section 110*a* of the footwear 110. In another embodiment (not shown), the flexible energy storage device 126 is positioned in a compartment (not shown) positioned on an outer surface of the footwear 110. In other embodiments, the flexible energy storage device 126 is positioned at any one or more preconfigured locations inside and/or outside the footwear 110. The flexible energy storage device 126 is operably connected to the pump 101, for example, using conducting wires 127. The flexible energy storage device 126 stores electrical energy and supplies electrical energy to the pump 101 via the switching unit 102 to actuate the pump 101. Examples of the flexible energy storage device 126 utilized in the ventilation apparatus 100 for supplying electrical energy to the pump 101 are a thin film flexible lithium ion battery, a thin film flexible lithium battery, a thin film flexible nickel cadmium battery, a thin film flexible zinc carbon battery, a thin film flexible carbon battery, etc. In an embodiment, the flexible energy storage device 126 is covered with a decorative layer for enhancing the aesthetic appeal of the footwear 110.

In an embodiment as exemplarily illustrated in FIGS. 14A-14B, the switching unit 102 of the ventilation apparatus 100 is positioned in the upper section 110*a* of the footwear 110. The switching unit 102 is in electric communication with the flexible energy storage device 126 and the pump 101. The switching unit 102 selectively changes modes of operation of the pump 101. The modes of operation of the pump 101 comprise, for example, a pump mode for pumping fluid 201 into the cavity 111 of the footwear 110 as exemplarily illustrated in FIGS. 18A-18B, and an exhaust mode for exhausting the fluid 201 from the cavity 111 of the footwear 110 as exemplarily illustrated in FIGS. 19A-19B. In an embodiment, the modes of operation of the pump 101 further comprise a termination mode for terminating the operation of the pump 101. In an embodiment, the switching unit 102 comprises distinct switches 102*a*, 102*b*, and 102*c* for selectively changing the modes of operation of the pump 101. In an embodiment, the ventilation apparatus 100 comprises a voltage regulator 128 for regulating voltage supplied to the pump 101 by the flexible energy storage device 126. When the switch 102*b* is activated or deactivated a preconfigured number of times, the voltage regulator 128 increases or decreases the voltage supplied from the flexible energy storage device 126 to the pump 101.

The pump 101 of the ventilation apparatus 100 is fixedly attached to a predefined section, for example, within the upper section 110*a* of the footwear 110, and is operably connected to the switching unit 102. The pump 101 is operably connected to the flexible energy storage device 126 via the switching unit 102. The pump 101 pumps fluid 201 into and exhausts fluid 201 from the cavity 111 of the footwear 110 on receiving the electrical energy from the flexible energy storage device 126 via the switching unit 102. The fluid 201 from the ambient environment enters the pump 101 through vents 112 configured on the pump 101 and positioned adjacent to the switches 102*a*, 102*b*, and 102*c* of the switching unit 102 on the upper section 110*a* of the footwear 110. The vents 112 are positioned above the pump 101 on the upper section 110*a* of the footwear 110. The fluid 201 from the cavity 111 of the footwear 110 exhausts the pump 101 through the vents 112. The pump 101 can be of different sizes and in an embodiment, can be positioned in any section of the footwear 110. The switch 102*a* of the switching unit 102 operates the pump 101 in the pump mode and the exhaust mode as disclosed in the detailed description of FIGS. 18A-19B. In an embodiment, the switch 102*b* operates the voltage regulator 128 to increase or decrease the voltage supplied to the pump 101, thereby changing the speed of the operation of the pump 101 according to the convenience of the user. The switch 102*c* of the switching unit 102 turns the ventilation apparatus 100 on and off. In an embodiment, multiple configurations of switches 102*a*, 102*b*, and 102*c* and/or other switches can be incorporated in the ventilation apparatus 100 and used to operate the pump 101 according to the convenience of the user.

The fluid diffuser 103 of the ventilation apparatus 100 is operably connected to the pump 101 and positioned within the cavity 111 of the footwear 110. The fluid diffuser 103 circulates the fluid 201 to and from the cavity 111 of the footwear 110. The fluid diffuser 103 comprises a feed pipe 104 and a diffusing member 105 with openings 106 in fluid communication with the feed pipe 104. The structure of the feed pipe 104 and the diffusing member 105 of the fluid diffuser 103 is disclosed in the detailed description of FIG. 1. In an embodiment, the ventilation apparatus 100 disclosed herein further comprises an energy converter 109 in electric communication with the flexible energy storage device 126, the switching unit 102, and the pump 101. The energy converter 109 converts direct current received from the flexible energy storage device 126 to an alternating current to be supplied to the pump 101 via the switching unit 102 to actuate the pump 101. In an embodiment, the flexible energy storage device 126 supplies direct current to the pump 101 via the switching unit 102. The voltage regulator 128 regulates the voltage supplied by the flexible energy storage device 126 to the pump 101 using the switch 102*b* that is in electric communication with the voltage regulator 128.

In an embodiment (not shown), the pump 101, the energy converter 109, the switching unit 102, the flexible energy storage device 126, and the voltage regulator 128 are positioned in one or more compartments (not shown) positioned on an outer surface of the footwear 110 to prevent any damage from the user's foot to the ventilation apparatus 100.

Figure 15:
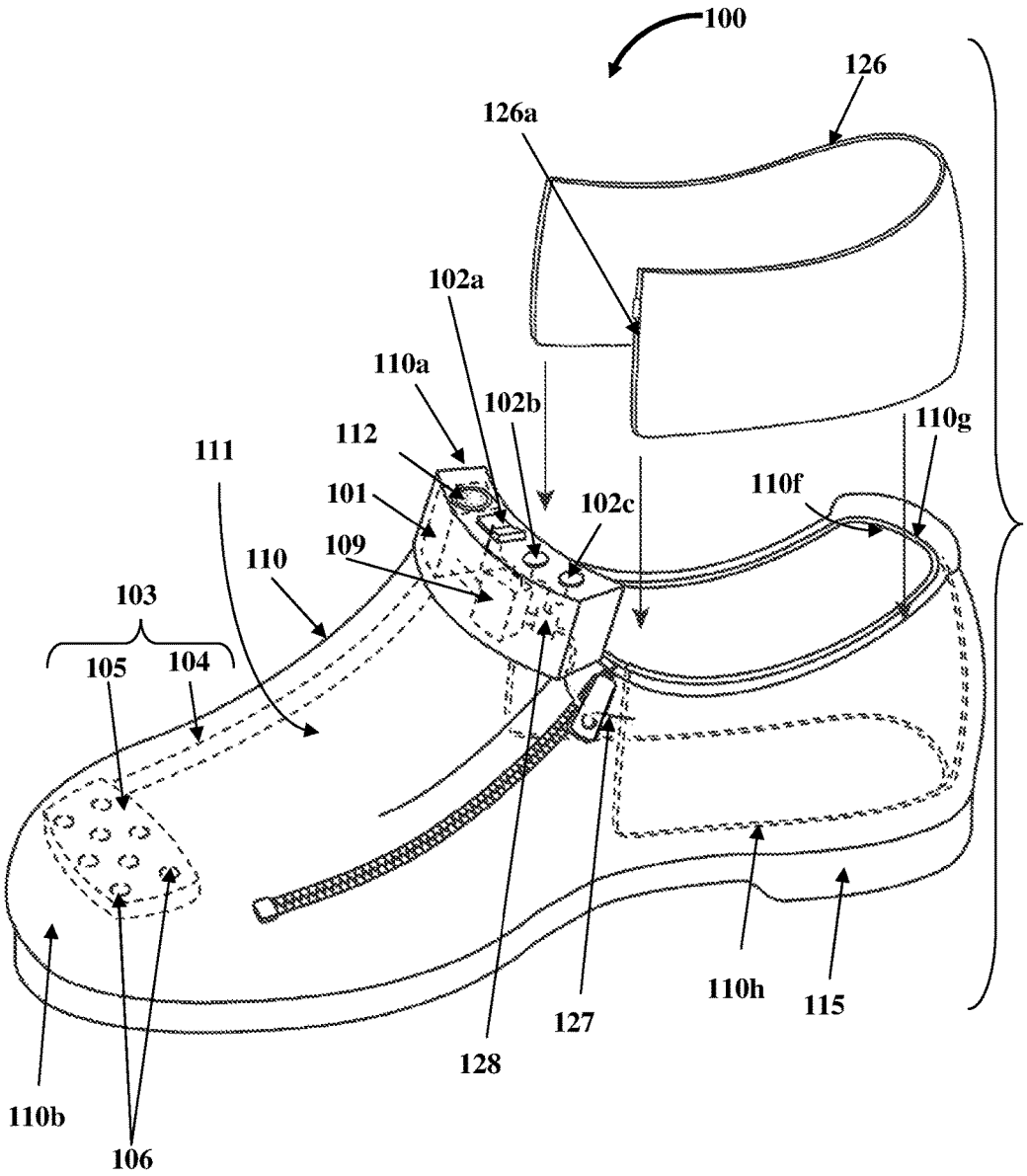
FIG. 15 exemplarily illustrates a partial disassembled view of the embodiment of the ventilation apparatus shown in FIG. 14A, showing positioning of a flexible energy storage device in a compartment of the footwear.

FIG. 15 exemplarily illustrates a partial disassembled view of the embodiment of the ventilation apparatus 100 shown in FIG. 14A, showing positioning of the flexible energy storage device 126 in a compartment 110*h* of the footwear 110. The compartment 110*h* is formed between the inner rear surface 110*f* and the outer rear surface 110*g* of the footwear 110. In an embodiment, more than one flexible energy storage device 126 is positioned in the compartment 110*h* of the footwear 110. The flexible energy storage device 126 conforms to the varying contours of the footwear 110 during walking, running, and other movements or physical activities performed by the user using the footwear 110.

The flexible energy storage device 126 disclosed herein comprises flexible substrates coated with anode and cathode materials for storing electrical energy. Different methods are used to coat the flexible substrates with the anode and cathode materials. The flexible energy storage device 126 comprises a solid polymer (not shown) as an electrolyte to facilitate transfer of ions from the anode to the cathode. The solid polymer is obtained by dissolving lithium salts, for example, lithium hexafluorophosphate ($LiPF_6$), lithium tetrafluoroborate ($LiBF_4$), or lithium perchlorate ($LiClO_4$) in polymer solvents, for example, polyethers, polyesters, polyimines, and polythiols. The solid polymer is deposited in multiple layers according to electric power capacity of the flexible energy storage device 126. The solid polymer electrolyte further acts as a binder and a separator, thereby reducing the need for multiple elements as in the case of conventional energy storage devices. Due to the flexibility of the substrates and the solid polymer electrolyte, the flexible storage device 126 can sustain small deforming forces that arise during the movement of the foot. In an embodiment, the electrolyte is a polymer matrix electrolyte, for example, the BrightVolt PME™ of BrightVolt Inc. In an embodiment, the flexible energy storage device 126 is rechargeable and can be used repetitively over extended periods of time.

In an embodiment, the flexible energy storage device 126 is configured as a stretchable power source. In this embodiment, the flexible energy storage device 126 comprises substantially small lithium-ion cells on a stretchable silicone substrate. The lithium-ion cells on the silicone substrate are connected by conducting wires. The lithium-ion cells are protected by silicone layers on the top and bottom of the lithium-ion cells. In an embodiment, each lithium-ion cell comprises a copper electrode sandwiched between two layers of polyimide. The lithium-ion cells are also provided with an anode slurry and a cathode slurry. A gel electrolyte is provided within a silicone spacer that separates the anode slurry and the cathode slurry of each lithium-ion cell. The gel electrolyte facilitates the transfer of ions from the anode slurry to the cathode slurry of the lithium-ion cell, which results in the flow of electrical energy. In an embodiment, the gel electrolyte is formed by dissolving an electrolyte in a polar solvent and adding an inactive polymeric material. An example of the gel electrolyte is a poly(vinylidene fluoride-co-hexafluoropropene) (PVDF-co-HFP) electrolyte obtained by mixing a lithium ion salt solution in carbonate esters.

In another embodiment (not shown), a flexible energy storage device 126 configured as a coil is used in the footwear 110. In this embodiment, the anode and cathode elements of the flexible energy storage device 126 are configured as coils and an electrolyte is poured in a hollow space formed by winding of the anode and cathode coils. The electrolyte is, for example, a solution of lithium salts such as lithium hexafluorophosphate ($LiPF_6$), lithium tetrafluoroborate ($LiBF_4$), or lithium perchlorate ($LiClO_4$) with organic solvents such as ethylene carbonate, dimethyl carbonate, and diethyl carbonate. A protective cover is provided to enclose the anode and cathode coils and the electrolyte. The flexible energy storage device 126 of different configurations can be inserted at multiple different locations inside and outside the footwear 110.

Figure 16:
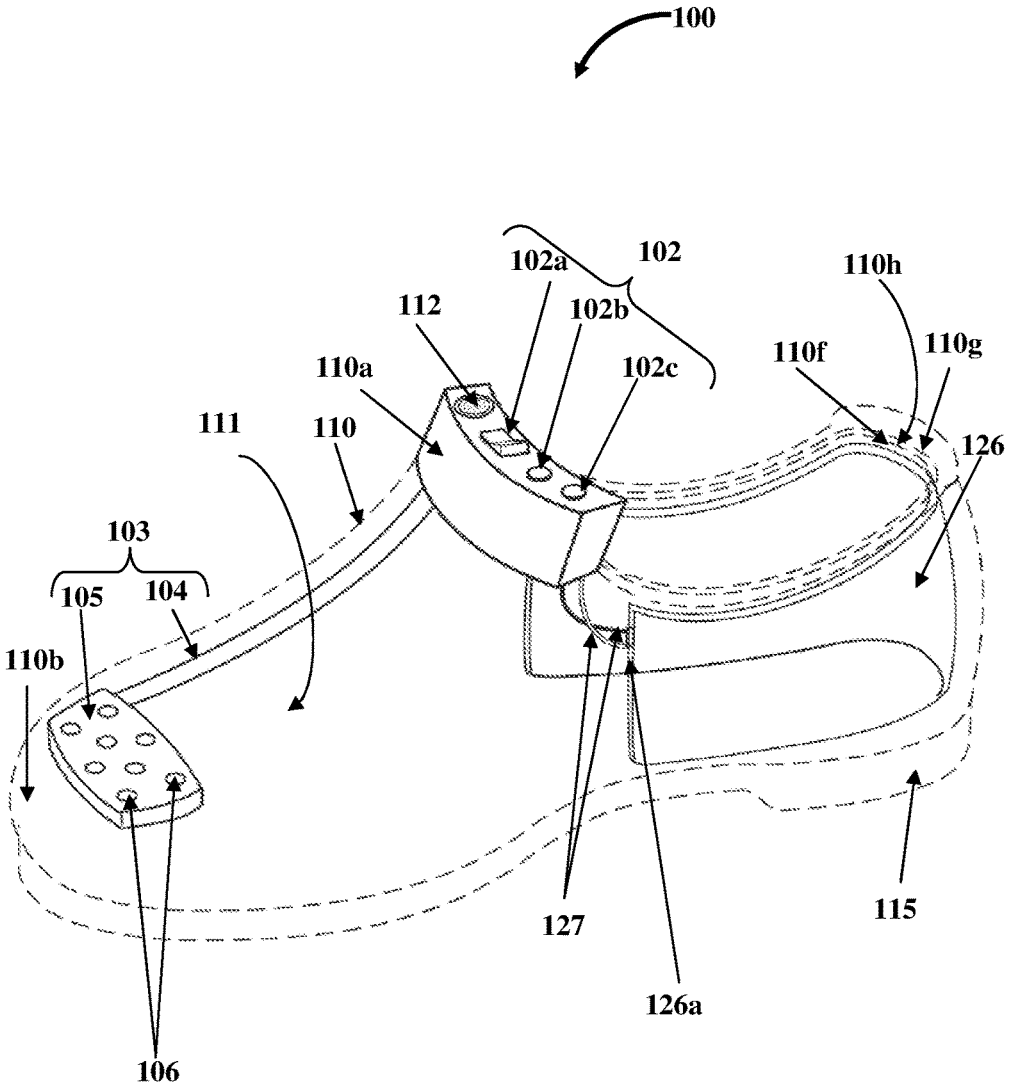
FIG. 16 exemplarily illustrates a right side perspective view of the embodiment of the ventilation apparatus shown in FIG. 14A, showing the flexible energy storage device electrically connected to the switching unit in the footwear.

FIG. 16 exemplarily illustrates a right side perspective view of the embodiment of the ventilation apparatus 100 shown in FIG. 14A, showing the flexible energy storage device 126 electrically connected to the switching unit 102 in the footwear 110. The flexible energy storage device 126 is electrically connected to the switching unit 102, the voltage regulator 128, the energy converter 109, and the pump 101 exemplarily illustrated in FIG. 14A and FIG. 15, using the conducting wires 127. In an embodiment, the conducting wires 127 extend from one end 126*a* of the flexible energy storage device 126 and connect to the switching unit 102, the voltage regulator 128, the energy converter 109, and the pump 101. The electrical energy from the flexible energy storage device 126 is transferred to the switching unit 102 through the conducting wires 127 and further transferred to the pump 101 through an electric circuit exemplarily illustrated in FIG. 20. The electrical energy actuates the pump 101 for circulating the fluid 201 exemplarily illustrated in FIGS. 18A-18B and FIGS. 19A-19B, into and out of the cavity 111 of the footwear 110.

Figure 17:
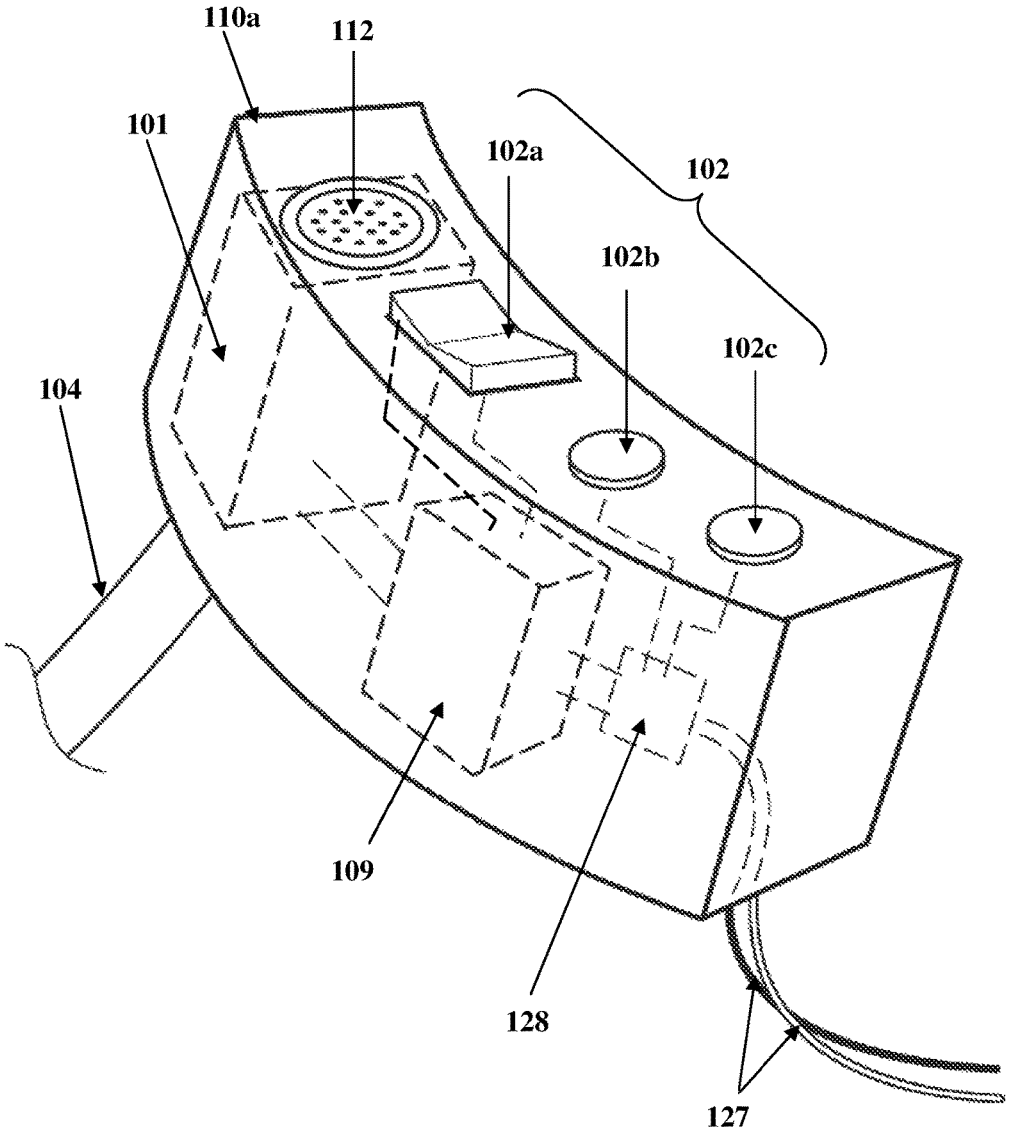
FIG. 17 exemplarily illustrates an enlarged view of an upper section of the footwear, showing components of the embodiment of the ventilation apparatus shown in FIG. 14A.

FIG. 17 exemplarily illustrates an enlarged view of an upper section 110*a* of the footwear 110, showing components of the embodiment of the ventilation apparatus 100 shown in FIG. 14A. The upper section 110*a* of the footwear 110 accommodates the pump 101, the switching unit 102, the voltage regulator 128, and the energy converter 109 as exemplarily illustrated in FIG. 17. The flexible energy storage device 126 exemplarily illustrated in FIG. 16, is positioned external to the upper section 110*a* of the footwear 110 and electrically communicates with the pump 101, the switching unit 102, the voltage regulator 128, and the energy converter 109 through the conducting wires 127. The upper section 110*a* of the footwear 110 also accommodates the switches 102*a*, 102*b*, and 102*c* of the switching unit 102. The switch 102*a* electrically controls the energy converter 109 and in turn the pump 101. The switch 102*b* electrically controls the voltage regulator 128 for increasing or decreasing the voltage supplied by the flexible energy storage device 126. The switch 102*c* controls activation and termination of the operation of the pump 101.

Figure 18A:
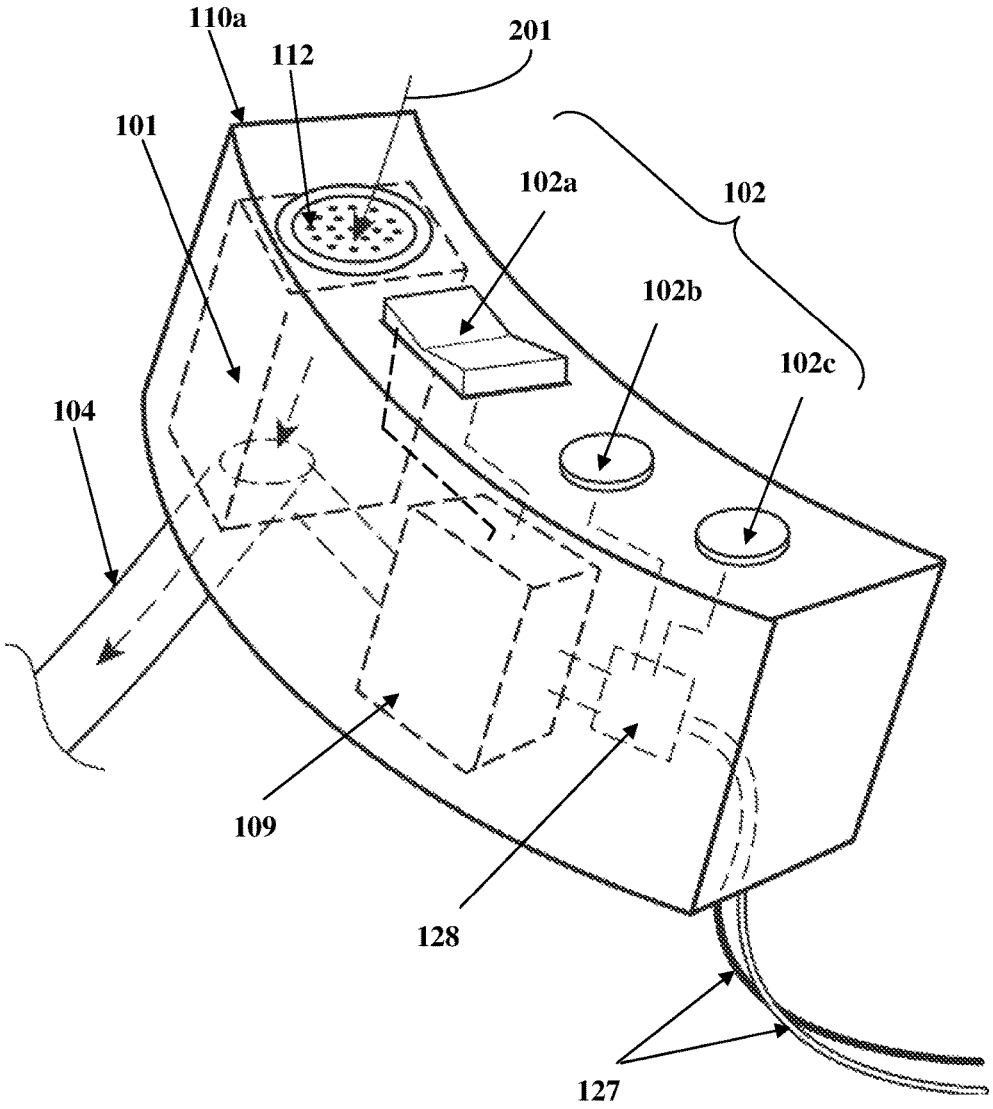
FIG. 18A exemplarily illustrates an enlarged view of the upper section of the footwear, showing a flow of fluid into the footwear in the pump mode of operation of the embodiment of the ventilation apparatus shown in FIG. 14A.

FIG. 18A exemplarily illustrates an enlarged view of the upper section 110*a* of the footwear 110, showing a flow of fluid 201 into the footwear 110 in the pump mode of operation of the embodiment of the ventilation apparatus 100 shown in FIG. 14A. When the switch 102*a* is pressed in a first position to activate the pump mode, the pump 101 pumps the fluid 201 from the ambient environment external to the footwear 110 through the vents 112 and into the cavity 111 of the footwear 110 through the feed pipe 104 of the fluid diffuser 103 as exemplarily illustrated in FIG. 18B.

Figure 18B:
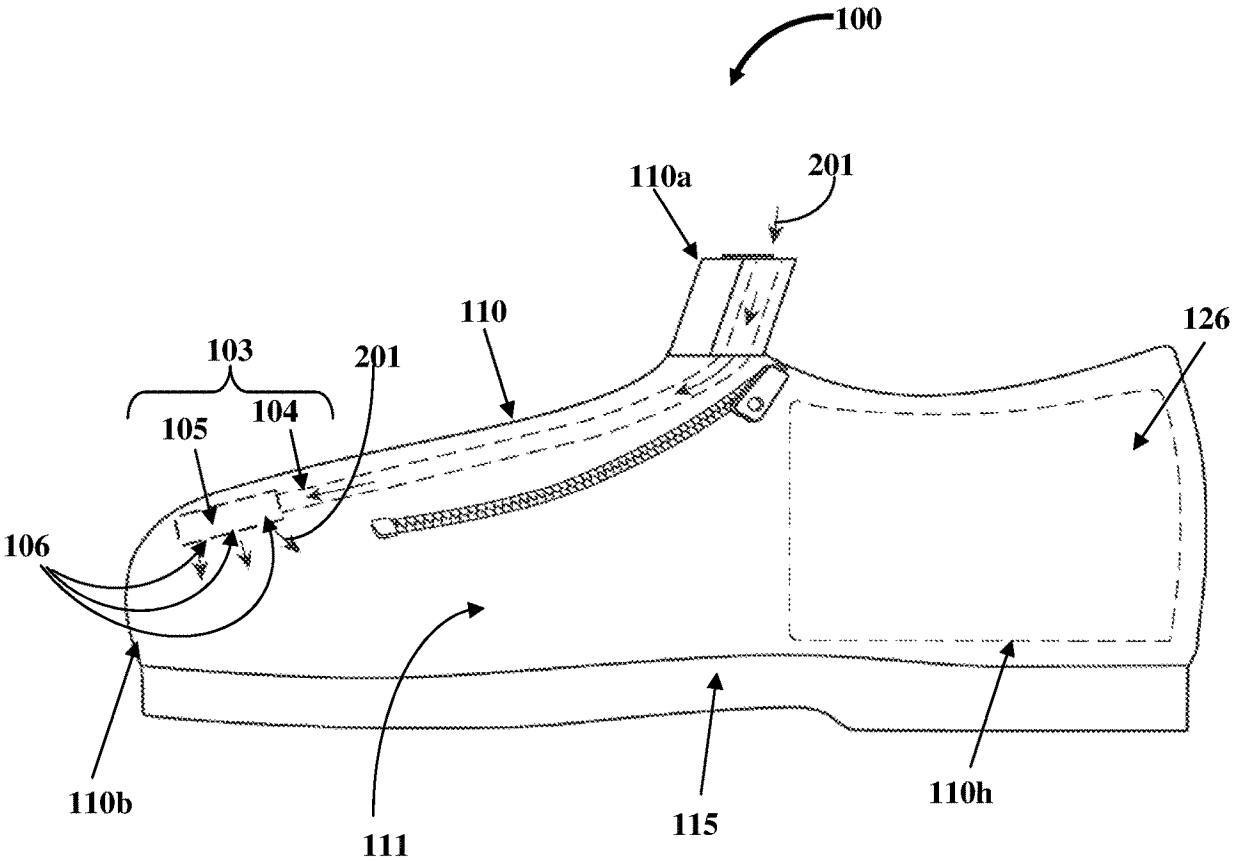
FIG. 18B exemplarily illustrates a right side elevation view of the embodiment of the ventilation apparatus shown in FIG. 14A, showing the flow of fluid into the footwear in the pump mode of operation.

FIG. 18B exemplarily illustrates a right side elevation view of the embodiment of the ventilation apparatus 100 shown in FIG. 14A, showing the flow of fluid 201 into the footwear 110 in the pump mode of operation. When the switch 102*a* is pressed to activate the pump mode, the pump 101 draws the fluid 201 from the ambient environment outside the footwear 110 through the vents 112 and into the feed pipe 104 of the fluid diffuser 103. The diffusing member 105 is in fluid communication with the feed pipe 104 and is positioned and attached proximal to the front end 110*b* of the footwear 110 in the cavity 111 of the footwear 110. The diffusing member 105 comprises openings 106 for allowing the fluid 201 pumped from the pump 101 through the feed pipe 104 to be transferred into the cavity 111 of the footwear 110 during the pump mode for ventilating the footwear 110.

Figure 19A:
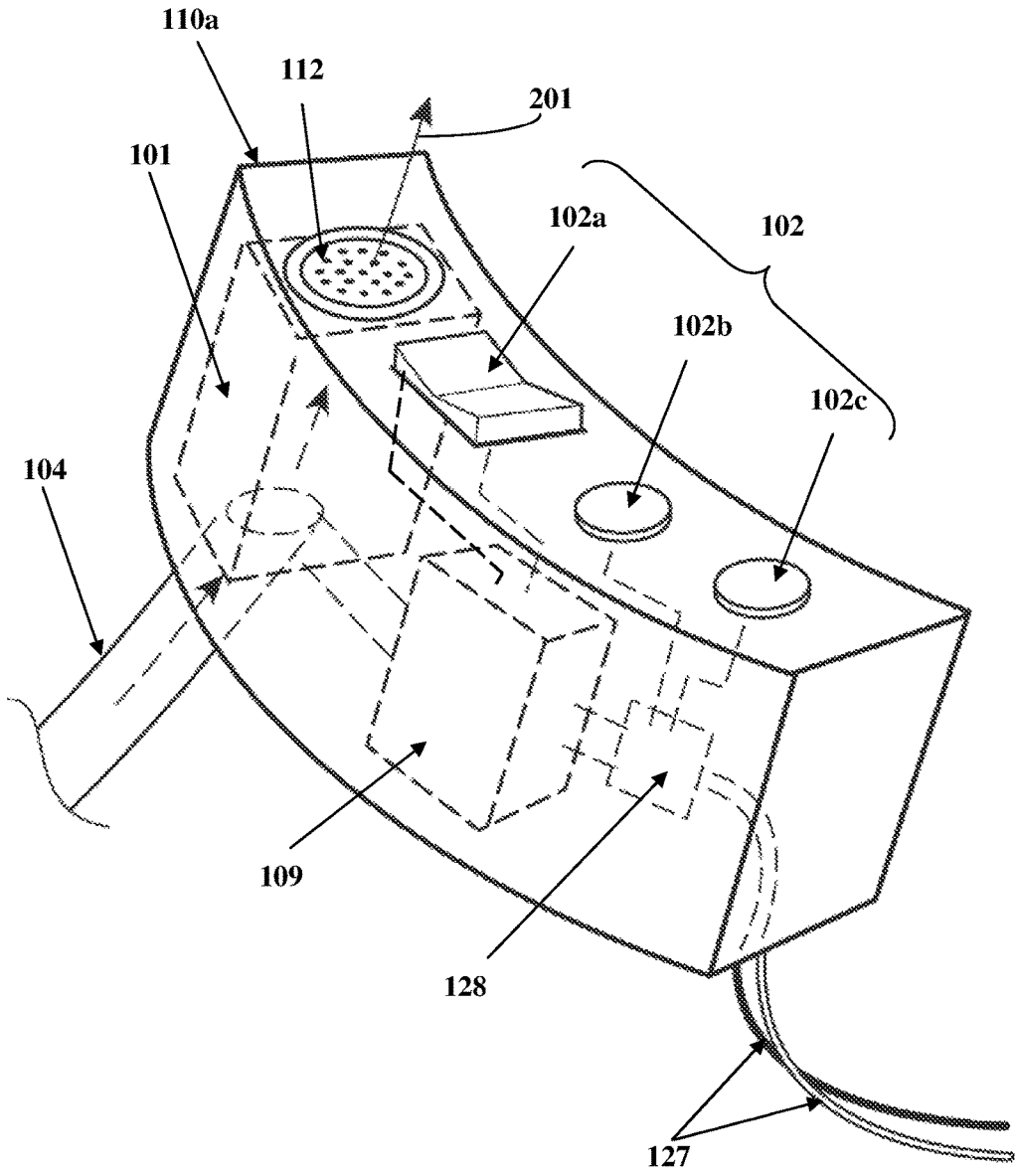
FIG. 19A exemplarily illustrates an enlarged view of the upper section of the footwear, showing a flow of fluid from the footwear to the ambient environment outside the footwear in the exhaust mode of operation of the embodiment of the ventilation apparatus shown in FIG. 14A.

FIG. 19A exemplarily illustrates an enlarged view of the upper section 110*a* of the footwear 110, showing a flow of fluid 201 from the footwear 110 to the ambient environment outside the footwear 110 in the exhaust mode of operation of the embodiment of the ventilation apparatus 100 shown in FIG. 14A. When the switch 102*a* is pressed in a second position to activate the exhaust mode, the pump 101 draws the fluid 201 from the cavity 111 of the footwear 110 exemplarily illustrated in FIG. 19B, and into the feed pipe 104, and exhausts the fluid 201 to the ambient environment outside the footwear 110 through the vents 112.

Figure 19B:
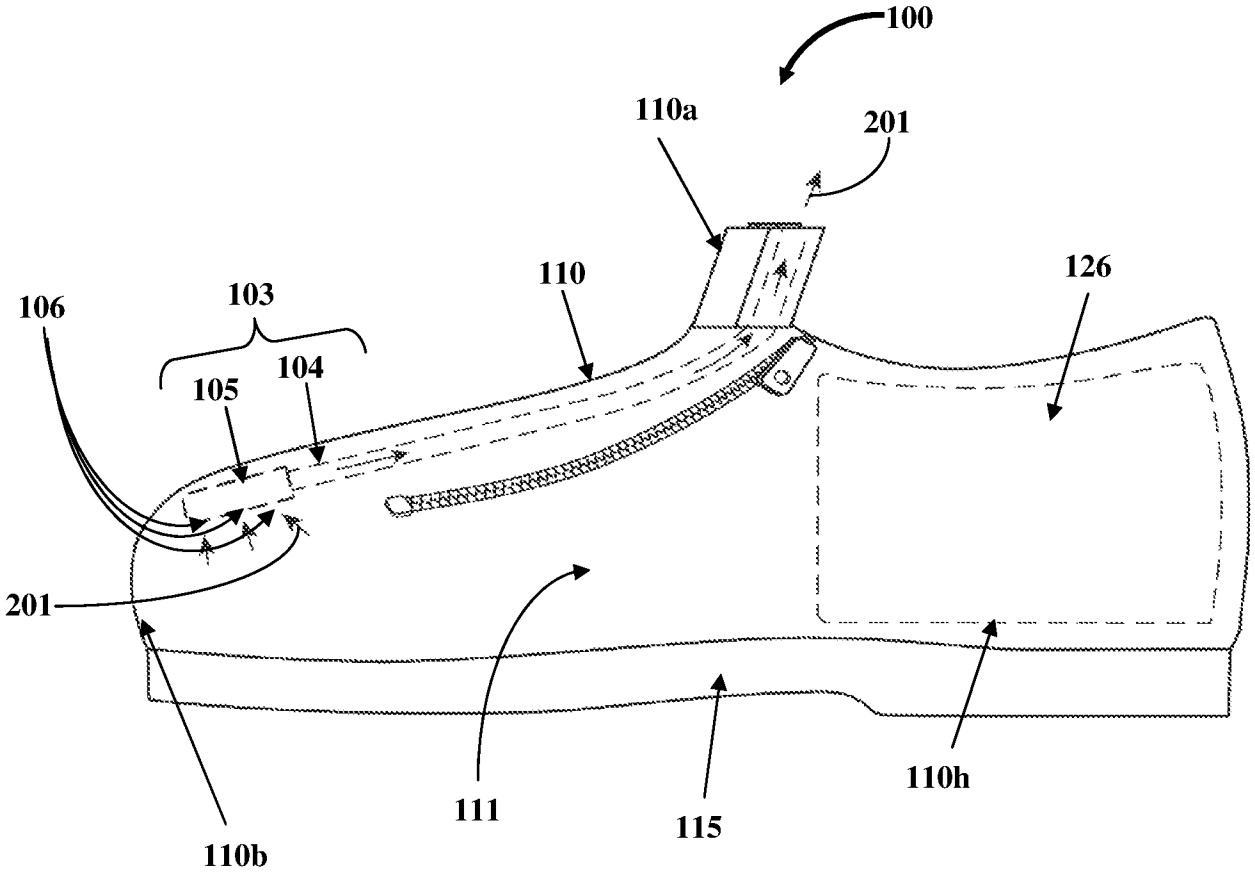
FIG. 19B exemplarily illustrates a right side elevation view of the embodiment of the ventilation apparatus shown in FIG. 14A, showing the flow of fluid to the ambient environment outside the footwear in the exhaust mode of operation.

FIG. 19B exemplarily illustrates a right side elevation view of the embodiment of the ventilation apparatus 100 shown in FIG. 14A, showing the flow of fluid 201 to the ambient environment outside the footwear 110 in the exhaust mode of operation. When the switch 102*a* is pressed to activate the exhaust mode, the pump 101 draws the fluid 201 from the cavity 111 of the footwear 110 as exemplarily illustrated in FIG. 19B, and into the feed pipe 104 of the fluid diffuser 103. The openings 106 of the diffusing member 105 allow the fluid 201 from the cavity 111 of the footwear 110 to be transferred through the feed pipe 104 and then through the vents 112 via the pump 101 to the ambient environment during the exhaust mode for ventilating the footwear 110.

Figure 20:
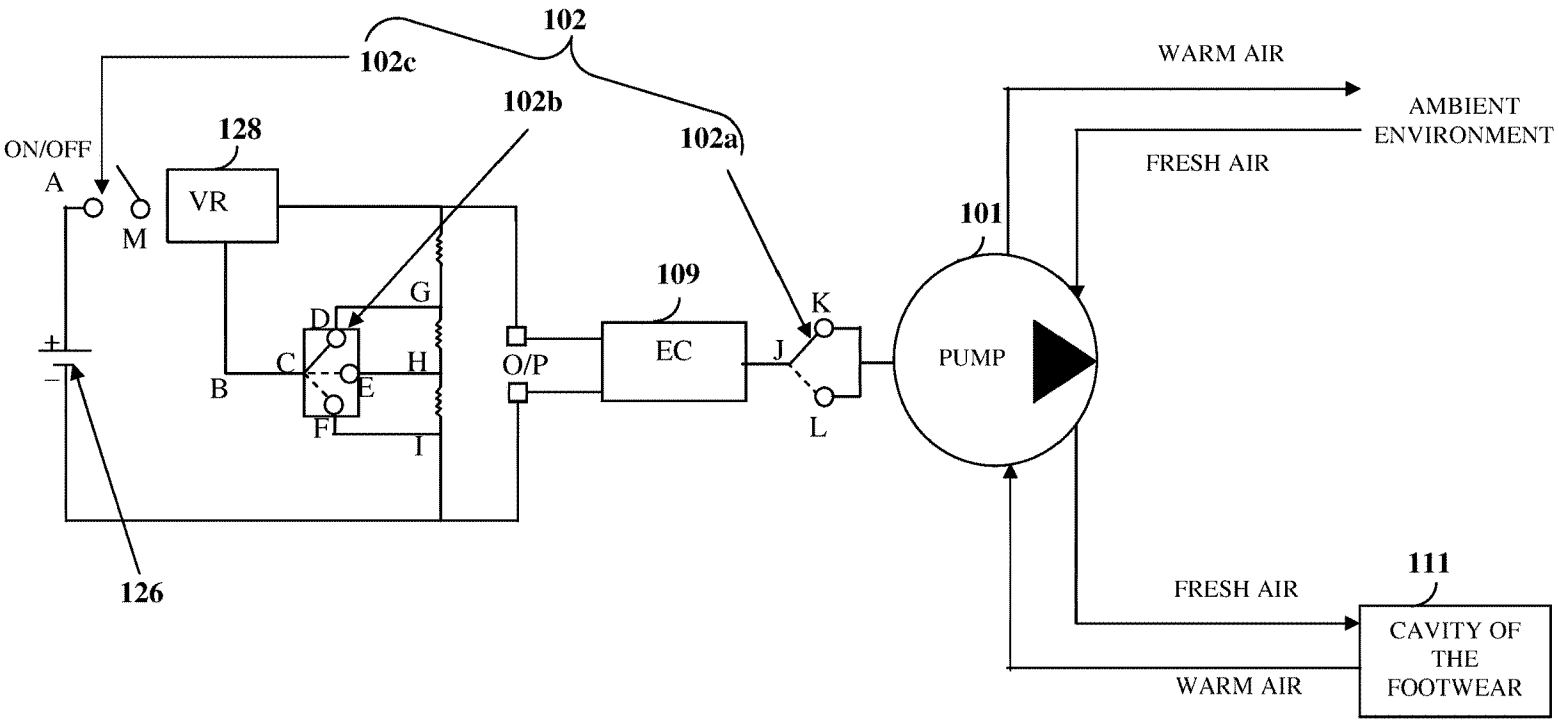
FIG. 20 exemplarily illustrates a block diagram showing an electric operation of the embodiment of the ventilation apparatus shown in FIG. 14A.

FIG. 20 exemplarily illustrates a block diagram showing an electric operation of the embodiment of the ventilation apparatus 100 shown in FIG. 14A. The electric circuitry of the ventilation apparatus 100 comprises electric connections between the pump 101, the energy converter (EC) 109, the voltage regulator (VR) 128, and the switches 102*a*, 102*b*, and 102*c* of the switching unit 102 with the flexible energy storage device 126. The block diagram exemplarily illustrated in FIG. 20, shows the electric operation of the pump 101 in the pump mode, the exhaust mode, and an ON and OFF mode. When the switch 102*c* is closed, the switch 102*c* establishes contact between points A and M of the electric circuitry exemplarily illustrated in FIG. 20, electrical energy, for example, electric current from the flexible energy storage device 126 circulates in the electric circuit formed by the conducting wires 127 exemplarily illustrated in FIGS. 16-17, that connect the flexible energy storage device 126, the voltage regulator 128, the energy converter 109, the switching unit 102, and the pump 101, and the electrical energy from the flexible energy storage device 126 flows to the voltage regulator 128 that is operated by the switch 102*b*. When the switch 102*b* is pressed for the first time, the switch 102*b* establishes contact between points C and D of the electric circuitry and transfers the electric current to the energy converter 109 through points D and G of the electric circuitry. When the switch 102*b* is engaged between the points C and D, the pump 101 operates in low speed. The energy converter 109 converts the electric current, for example, direct current from the flexible energy storage device 126 to alternating current that is fed to the pump 101. Pressing the switch 102*a* in the first position establishes contact between points J and K of the electric circuitry and activates the pump mode. During the pump mode, the pump 101 draws the fluid 201, for example, fresh air from the ambient environment, through the vents 112 exemplarily illustrated in FIG. 18A, and pumps the fluid 201 into the cavity 111 of the footwear 110 through the feed pipe 104 and the diffusing member 105 of the fluid diffuser 103 exemplarily illustrated in FIG. 18B.

Pressing the switch 102*a* in the second position establishes contact between points J and L of the electric circuitry and activates the exhaust mode. During the exhaust mode, the pump 101 draws fluid 201, for example, warm air from the cavity 111 of the footwear 110, through the diffusing member 105, and pumps the fluid 201 through the feed pipe 104 and the vents 112 to the ambient environment as exemplarily illustrated in FIGS. 19A-19B. When the switch 102*b* is pressed for the second time, the switch 102*b* establishes contact between points C and E of the electric circuitry. The electric current passes through points E and H of the electric circuitry to the pump 101 through the energy converter 109 and the pump 101 operates at a medium speed when the switch 102*b* is in contact with the points C and E of the electric circuitry. When the switch 102*b* is pressed for the third time, the switch 102*b* establishes contact between points C and F of the electric circuitry. The electric current passes through the points F and Ito the pump 101 through the energy converter 109 and the pump 101 operates at a high speed when the switch 102*b* is in contact with the points F and I of the electric circuitry. When the switch 102*c* is pressed for the second time, the contact between the points A and M is disconnected and the pump 101 stops since no electric current flows in the electric circuit.

The foregoing examples have been provided merely for the purpose of explanation and are in no way to be construed as limiting of the ventilation apparatus 100 and the method disclosed herein. While the ventilation apparatus 100 and the method disclosed herein have been described with reference to various embodiments, it is understood that the words, which have been used herein, are words of description and illustration, rather than words of limitation. Furthermore, although the ventilation apparatus 100 and the method have been described herein with reference to particular means, materials, and embodiments, the ventilation apparatus 100 and the method disclosed herein are not intended to be limited to the particulars disclosed herein; rather, the ventilation apparatus 100 and the method disclosed herein extend to all functionally equivalent structures, methods and uses, such as are within the scope of the appended claims. Those skilled in the art, having the benefit of the teachings of this specification, may effect numerous modifications thereto and changes may be made without departing from the scope and spirit of the ventilation apparatus 100 and the method disclosed herein in their aspects.

I claim:

1. An article of footwear with a ventilation apparatus, comprising:

said ventilation apparatus comprising a set of parts attached to said footwear, said set of parts comprising:

at least one flexible energy storage device positioned at one or more of a plurality of preconfigured locations of said footwear, said at least one flexible energy storage device configured to flexibly conform to varying contours of said footwear, said at least one flexible energy storage device further configured to store electrical energy;

an electric pump disposed on an ankle section of said footwear;

a switching unit disposed on said ankle section of said footwear, said switching unit in electric communication with said at least one flexible energy storage device and said electric pump, said switching unit selectively changing modes of operation of said electric pump, said modes of operation comprising:

a pump mode for pumping fluid from an ambient environment external to said footwear into a cavity of said footwear when said electric pump receives said electrical energy from said at least one flexible energy storage device via said switching unit; and an exhaust mode for exhausting said fluid from said cavity of said footwear to said ambient environment external to said footwear when said electric pump receives said electrical energy from said at least one flexible energy storage device via said switching unit; and a fluid diffuser comprising:

a diffusing member positioned within said cavity of said footwear and operably connected to said electric pump in said ankle section through a feed pipe; and said feed pipe connected to and extending from said electric pump in said ankle section into said diffusing member, said feed pipe positioned within said footwear proximal to an inner surface of said footwear, wherein said feed pipe and said diffusing member transfer said fluid from said ambient environment external to said footwear to said cavity of said footwear during said pump mode, and wherein said feed pipe and said diffusing member transfer said fluid in said cavity of said footwear to said ambient environment external to said footwear during said exhaust mode, for ventilating said footwear.

2. The article of footwear with the ventilation apparatus of claim 1, wherein said at least one flexible energy storage device comprises one or more substantially thin electric power layers that flexibly conform to said varying contours of said footwear and sustain deforming forces that arise during usage of said footwear.

3. The article of footwear with the ventilation apparatus of claim 1, wherein said at least one flexible energy storage device is rechargeable and usable over extended periods of time.

4. The article of footwear with the ventilation apparatus of claim 1, wherein said preconfigured locations for accommodating said at least one flexible energy storage device comprise a location between an inner rear surface and an outer rear surface of said footwear and a location on an outer surface of said footwear.

5. The article of footwear with the ventilation apparatus of claim 1, wherein said diffusing member is positioned and attached proximal to a front end of said footwear in said cavity of said footwear, and wherein said diffusing member comprises one or more openings for allowing said fluid pumped from said electric pump through said feed pipe to be transferred into said cavity of said footwear during said pump mode and for allowing said fluid in said cavity of said footwear to be transferred through said feed pipe to said ambient environment external to said footwear during said exhaust mode, for ventilating said footwear.

6. The article of footwear with the ventilation apparatus of claim 1, further comprising an energy converter, in electric communication with said at least one flexible energy storage device, said switching unit, and said electric pump, for converting direct current received from said at least one flexible energy storage device to an alternating current to be supplied to said electric pump via said switching unit to actuate said electric pump.

7. The article of footwear with the ventilation apparatus of claim 1, wherein said modes of operation of said electric pump further comprise a termination mode for terminating said operation of said electric pump.

* * * * *